US012668925B2

(12) United States Patent
Shindo et al.

(10) Patent No.: US 12,668,925 B2
(45) Date of Patent: Jun. 30, 2026

(54) FIBER DIAMETER MEASURING DEVICE, INORGANIC FIBER SHEET PRODUCING DEVICE, METHOD FOR MEASURING FIBER DIAMETER, AND METHOD FOR PRODUCING INORGANIC FIBER SHEET

(71) Applicant: MAFTEC CO., LTD., Tokyo (JP)

(72) Inventors: Shinji Shindo, Tokyo (JP); Kazunori Kawahara, Tokyo (JP); Tetsuji Jonishi, Tokyo (JP)

(73) Assignee: MAFTEC CO., LTD., Tokyo (JP)

( * ) Notice: Subject to any disclaimer, the term of this patent is extended or adjusted under 35 U.S.C. 154(b) by 808 days.

(21) Appl. No.: 17/795,275

(22) PCT Filed: Feb. 1, 2021

(86) PCT No.: PCT/JP2021/003596
§ 371 (c)(1),
(2) Date: Jul. 26, 2022

(87) PCT Pub. No.: WO2021/153800
PCT Pub. Date: Aug. 5, 2021

(65) Prior Publication Data

US 2023/0143567 A1 May 11, 2023

(30) Foreign Application Priority Data

Jan. 31, 2020 (JP) ..... 2020-015586

(51) Int. Cl.
*D21G 9/00* (2006.01)
*D06H 3/00* (2006.01)
(Continued)

(52) U.S. Cl.
CPC ..... *D21G 9/0027* (2013.01); *D06H 3/00* (2013.01); *D21H 13/38* (2013.01); *D21H 13/46* (2013.01); *D10B 2101/06* (2013.01)

(58) Field of Classification Search
CPC ..... D21H 13/46; D21H 13/38; D21G 9/0027
(Continued)

(56) References Cited

U.S. PATENT DOCUMENTS 2,940,134 A * 6/1960 Heritage ..... B27N 3/14 264/109
3,315,530 A * 4/1967 Woodley, Jr. ..... G01N 1/2202 73/863.41
(Continued)

FOREIGN PATENT DOCUMENTS

CN 202255294 U 5/2012
JP 2014-115195 A 6/2014
(Continued)

OTHER PUBLICATIONS

"Regulations", Official Journal of the European Union, Aug. 24, 2009, pp. 1-94.
(Continued)

*Primary Examiner* — Jacob T Minskey
(74) *Attorney, Agent, or Firm* — Sughrue Mion, PLLC

(57) ABSTRACT

A fiber diameter measuring device, an inorganic fiber sheet producing device, a method for measuring a fiber diameter, and a method for producing an inorganic fiber sheet, capable of guaranteeing continuous safeness of the fiber diameter of an inorganic fiber in an inorganic fiber sheet is provided. A method further capable of measuring the fiber diameter of the inorganic fiber in the inorganic fiber sheet, not only after the production of the inorganic fiber sheet but also during the production of the inorganic fiber sheet is provided. The fiber diameter measuring device includes a sampling section capable of sampling a predetermined amount of the inorganic fiber in an entire area of the inorganic fiber sheet; and a measuring section configured to measure a fiber diameter of the sampled inorganic fiber.

20 Claims, 3 Drawing Sheets

(51) Int. Cl.
*D21H 13/38* (2006.01)
*D21H 13/46* (2006.01)

(58) Field of Classification Search
USPC ..... 162/198
See application file for complete search history.

(56) References Cited

U.S. PATENT DOCUMENTS

| | | | | |
|---|---|---|---|---|
| 5,930,870 | A | 8/1999 | Leifeld et al. | |
| 2003/0219590 | A1 | 11/2003 | Shoji et al. | |
| 2005/0078322 | A1* | 4/2005 | Pirinoli | G01B 11/105 356/638 |
| 2008/0057817 | A1 | 3/2008 | Aoki | |
| 2009/0087652 | A1* | 4/2009 | Kakikura | C04B 35/63468 428/401 |
| 2014/0186599 | A1 | 7/2014 | Fukui et al. | |
| 2021/0123173 | A1* | 4/2021 | De Rovere | D04H 1/4391 |

FOREIGN PATENT DOCUMENTS

| | | | |
|---|---|---|---|
| JP | 2016-108683 | A | 6/2016 |
| WO | 2013/035645 | A1 | 3/2013 |

OTHER PUBLICATIONS

International Search Report of PCT/JP2021/003596 dated Apr. 13, 2021 [PCT/ISA/210].

* cited by examiner

FIBER DIAMETER MEASURING DEVICE, INORGANIC FIBER SHEET PRODUCING DEVICE, METHOD FOR MEASURING FIBER DIAMETER, AND METHOD FOR PRODUCING INORGANIC FIBER SHEET

CROSS REFERENCE TO RELATED APPLICATIONS

This application is a National Stage of International Application No. PCT/JP2021/003596, filed Feb. 1, 2021, claiming priority to Japanese Patent Application No. 2020-015586, filed Jan. 31, 2020.

TECHNICAL FIELD

The present disclosure relates to a fiber diameter measuring device configured to measure a fiber diameter of an inorganic fiber in an inorganic fiber sheet, an inorganic fiber sheet producing device using the same, a method for measuring a fiber diameter, and a method for producing an inorganic fiber sheet.

BACKGROUND ART

Inorganic fiber moldings are widely used in applications such as industrial insulation, refractories, and packing materials, wherein they are exposed to high temperature conditions. In recent years, inorganic fiber moldings have also been used as cushioning materials for automobile exhaust gas purifying devices, that is, holding materials for exhaust gas purifying devices which are wound around the exhaust gas treatment body when the exhaust gas treating body such as a catalyst carrier and a particle filter is housed in a metallic casing, and which are interposed between the exhaust gas treating body and the casing.

However, ceramic fibers might cause health disorders such as carcinogenicity, and regulations for inorganic fibers have been strengthened.

Examples of an indicator for safeness of an inorganic fiber molding may include a fiber diameter of an inorganic fiber in an inorganic fiber molding. For example, the World Health Organization (WHO) defines a fibrous material that is inhaled into the body with human respiration and reaches the lungs as "inhalable fiber" with a length more than 5 μm, a diameter less than 3 μm, and an aspect ratio (length to diameter ratio) more than 3.

When measuring a fiber diameter of an inorganic fiber in a sheet-shaped inorganic fiber molding (inorganic fiber sheet), the following method is generally carried out; a method wherein a part of an inorganic fiber sheet is punched out or cut out to collect a test piece having a predetermined size, and a fiber diameter of an inorganic fiber in the test piece is measured (see, for example, Non-patent Literature 1). The above process is based on an assumption that, when the production conditions of the inorganic fiber sheet are constant, the average fiber diameter and the fiber diameter distribution, for example, of the inorganic fiber sheet will be the same. However, in the above method, it cannot be said that the reliability of the fiber diameter is guaranteed with respect to the lot or the portion that is not measured. Therefore, there is a need for a measuring method that guarantees continuity and uniformity of average fiber diameter and fiber diameter distribution, for example, in the entire area of the inorganic fiber sheet, in other words, a method that guarantees the safeness of the fiber diameter in the entire area of the inorganic fiber sheet, that is, a method that guarantees the continuous safeness of the fiber diameter in the inorganic fiber in an inorganic fiber sheet.

Also, in the above method, since a part of the inorganic fiber sheet is punched out or cut out for sampling, the inorganic fiber sheet after sampling cannot be used as a product.

Further, the above method is a method wherein the fiber diameter is measured off-line after the production of an inorganic fiber sheet, and it is not possible to measure the fiber diameter on-line during production of a inorganic fiber sheet. Particularly, in a case of a lengthy inorganic fiber sheet, only the fiber diameter of the punched out or cut out part as a test piece may be confirmed by the off-line method. Therefore, a method wherein the fiber diameter is measured for the entire width and the entire length of the lengthy inorganic fiber sheet, is important.

CITATION LIST

Non-Patent Literature

Non-patent Literature 1: COMMISSION REGULATION (EC) No. 761/2009 of 23 Jul. 2009

SUMMARY OF DISCLOSURE

Technical Problem

In response to such problems, the present inventors have studied a method wherein, in measuring a fiber diameter, reliability of the fiber diameter may be guaranteed, and an object may be used as a product even after measurement of a fiber diameter, and further, a fiber diameter may be measured on-line during production of an inorganic fiber sheet, rather than offline as described above. However, effective methods for such methods have not yet been established.

The present disclosure has been made in view of the above circumstances, and a main object of the present disclosure is to provide a fiber diameter measuring device, an inorganic fiber sheet producing device, a method for measuring a fiber diameter, and a method for producing an inorganic fiber sheet capable of guaranteeing continuity and uniformity of the fiber diameter of an inorganic fiber in an inorganic fiber sheet; also, capable of guaranteeing continuous safeness of the fiber diameter of an inorganic fiber in an inorganic fiber sheet; and further, capable of measuring the fiber diameter of the inorganic fiber in the inorganic fiber sheet, not only after the production of the inorganic fiber sheet but also during the production of the inorganic fiber sheet.

Solution to Problem

In order to achieve the object, the present disclosure provides a fiber diameter measuring device configured to measure a fiber diameter of an inorganic fiber in an inorganic fiber sheet including the inorganic fiber, the device comprising, a sampling section capable of sampling a predetermined amount of the inorganic fiber in an entire area of the inorganic fiber sheet; and a measuring section configured to measure a fiber diameter of the sampled inorganic fiber, and as necessary, the sampling section includes a sample transferring section configured to transfer the inorganic fiber, a pretreating section configured to assist the sampling of the inorganic fiber, and a sample collecting section configured to collect the inorganic fiber.

According to the present disclosure, since a predetermined amount of the inorganic fiber may be sampled in the entire area of the inorganic fiber sheet in the sampling section, the sampled inorganic fiber may be regarded as representing the inorganic fiber in the inorganic fiber sheet. Therefore, it is possible to improve the reliability of the fiber diameter of the measured inorganic fiber. Also, in sampling section, since the inorganic fiber sheet is not punched out or cut out for sampling, the fiber diameter of the inorganic fiber in the inorganic fiber sheet may be measured on-line. Still more, since the appearance of the inorganic fiber sheet may be suppressed from being impaired by measurement of the fiber diameter, the inorganic fiber sheet may be used as a product even after measurement of the fiber diameter.

In the present disclosure, the sampling section may include a sample transferring section placed on one side or both sides of the inorganic fiber sheet, and configured to transfer the inorganic fiber. In this case, the sample transferring section may be a suctioning section configured to suction the inorganic fiber.

Also, in the present disclosure, the sampling section may include a pretreating section configured to assist the sampling of the inorganic fiber. In this case, the pretreating section may be a physically contactless section configured to be physically contactless with the inorganic fiber sheet. Also, in this case, the physically contactless section may be a feeding section configured to feed a gas or a liquid to the inorganic fiber sheet, from one side or both sides of the inorganic fiber sheet. Also, the pretreating section may be a physically contacting section configured to be in physically contact with the inorganic fiber sheet.

Also, in the present disclosure, as the pretreating section, the sampling section may include a vibration section configured to impart a vibration to the inorganic fiber sheet.

Also, in the present disclosure, the sampling section may include a sample collecting section configured to collect the inorganic fiber.

The present disclosure also provides an inorganic fiber sheet producing device comprising the fiber diameter measuring device described above.

According to the present disclosure, by comprising the fiber diameter measuring device described above, it is possible to improve the reliability of the fiber diameter of the measured inorganic fiber. Also, by comprising the fiber diameter measuring device described above, the fiber diameter of the inorganic fiber in the inorganic fiber sheet may be measured on-line. Still more, variation of the fiber diameter of the inorganic fiber and deviation from acceptable range may be checked on-line. Therefore, by feeding the result back to the production process, for example, of the inorganic fiber sheet, and controlling the production conditions, for example, of the inorganic fiber sheet, the fiber diameter of the inorganic fiber may be kept in a predetermined standard range. Also, by comprising the fiber diameter measuring device described above, an inorganic fiber sheet with good appearance even after the measurement of the fiber diameter may be obtained.

In the inorganic fiber sheet producing device in the present disclosure, a burning section configured to burn an inorganic fiber precursor sheet including an inorganic fiber precursor continuously, is preferably provided on an upstream side of the fiber diameter measuring device. This is because the present disclosure is useful for producing a lengthy inorganic fiber sheet.

The present disclosure also provides a method for measuring a fiber diameter measuring a fiber diameter of an inorganic fiber in an inorganic fiber sheet including the inorganic fiber, the method comprising, a sampling step of sampling the inorganic fiber from the inorganic fiber sheet by a sampling method capable of sampling a predetermined amount of the inorganic fiber in an entire area of the inorganic fiber sheet; and a measuring step of measuring the fiber diameter of the sampled inorganic fiber.

According to the present disclosure, since a predetermined amount of the inorganic fiber may be sampled in the entire area of the inorganic fiber sheet in the sampling step, it is possible to improve the reliability of the fiber diameter of the measured inorganic fiber. Also, since the inorganic fiber sheet is not punched out or cut out for sampling, the fiber diameter of the inorganic fiber in the inorganic fiber sheet may be measured on-line. Still more, since the appearance of the inorganic fiber sheet may be suppressed from being impaired by measurement of the fiber diameter, the inorganic fiber sheet may be used as a product even after measurement of the fiber diameter.

In the present disclosure, in the sampling step, the inorganic fiber may be transferred by a sample transferring section placed on one side or both sides of the inorganic fiber sheet, and configured to transfer the inorganic fiber. Also, in the present disclosure, in the sampling step, the sampling of the inorganic fiber may be assisted by a pretreating section configured to assist the sampling of the inorganic fiber.

The present disclosure further provides a method for producing an inorganic fiber sheet, the method comprising, a sampling step of sampling an inorganic fiber from an inorganic fiber sheet by a sampling method capable of sampling a predetermined amount of the inorganic fiber in an entire area of the inorganic fiber sheet including the inorganic fiber; and a measuring step of measuring the fiber diameter of the sampled inorganic fiber.

According to the present disclosure, since a predetermined amount of the inorganic fiber may be sampled in the entire area of the inorganic fiber sheet in sampling step, it is possible to improve the reliability of the fiber diameter of the measured inorganic fiber. Also, since the inorganic fiber sheet is not punched out or cut out for sampling, the fiber diameter of the inorganic fiber in the inorganic fiber sheet may be measured on-line. Also, an inorganic fiber sheet with good appearance even after the measurement of the fiber diameter may be obtained.

In the present disclosure, in the sampling step, the inorganic fiber may be transferred by a sample transferring section placed on one side or both sides of the inorganic fiber sheet, and configured to transfer the inorganic fiber. Also, in the present disclosure, in the sampling step, the sampling of the inorganic fiber may be assisted by a pretreating section configured to assist the sampling of the inorganic fiber.

Also, prior to the sampling step, the method for producing an inorganic fiber sheet in the present disclosure preferably comprises a preparing step of preparing an inorganic fiber precursor sheet including an inorganic fiber precursor; and a burning step of burning the inorganic fiber precursor sheet continuously to obtain the inorganic fiber sheet. This is because the present disclosure is useful for producing a lengthy inorganic fiber sheet.

Also, in the present disclosure, when the fiber diameter measured in the measuring step is out of a previously set predetermined range, a result thereof may be fed back, and a producing condition of the inorganic fiber precursor sheet and/or a burning condition in the burning step may be controlled so that the fiber diameter is in the predetermined range. Variation of the fiber diameter of the inorganic fiber and deviation from acceptable range may be checked on-line. Therefore, by feeding the result back, and controlling the producing conditions of the inorganic fiber precursor sheet, and/or the burning conditions in the burning step, the fiber diameter of the inorganic fiber may be kept in an acceptable range.

Also, in the present disclosure, the inorganic fiber sheet subjected to the sampling step is preferably an inorganic fiber sheet subjected to a needling treatment. This is because the present disclosure is useful for the inorganic fiber sheet subjected to a needling treatment.

Advantageous Effects of Disclosure

The present disclosure exhibits effects of being capable of guaranteeing continuity and uniformity of the fiber diameter of an inorganic fiber in an inorganic fiber sheet; also, capable of guaranteeing continuous safeness of the fiber diameter of an inorganic fiber in an inorganic fiber sheet; and further, capable of measuring the fiber diameter of the inorganic fiber in the inorganic fiber sheet, not only after the production of the inorganic fiber sheet but also during the production of the inorganic fiber sheet.

DESCRIPTION OF EMBODIMENTS

Figure 1:
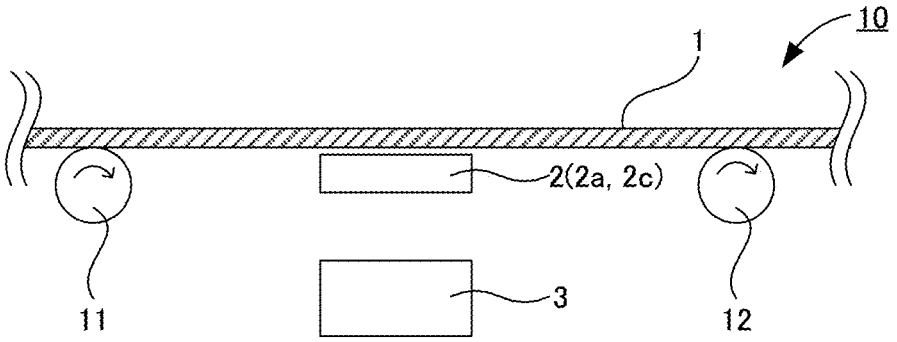
FIG. 1 is a schematic view illustrating an example of a fiber diameter measuring device in the present disclosure.

The fiber diameter measuring device, the inorganic fiber sheet producing device, the method for measuring a fiber diameter, and the method for producing an inorganic fiber sheet in the present disclosure are hereinafter explained.

A. Fiber Diameter Measuring Device

Firstly, the fiber diameter measuring device in the present disclosure is explained. The fiber diameter measuring device in the present disclosure is configured to measure a fiber diameter of an inorganic fiber in an inorganic fiber sheet including the inorganic fiber, the device comprising, a sampling section capable of sampling a predetermined amount of the inorganic fiber in an entire area of the inorganic fiber sheet; and a measuring section configured to measure a fiber diameter of the sampled inorganic fiber.

Here, the phrase "an entire area of the inorganic fiber sheet" refers to the bare minimum area required for sampling a fiber diameter measuring sample representing the entire inorganic fiber sheet, and refers to the entire area in the in-plane direction of an inorganic fiber sheet, and is preferably the entire area in the in-plane direction and the thickness direction of an inorganic fiber sheet.

In the present disclosure, a fiber diameter measuring sample representing the entire inorganic fiber sheet is collected by carrying out a sampling from one side or both sides of the inorganic fiber sheet by the sampling section as described later. Whether the sampling of the inorganic fiber by the sampling section is carried out from one side of the inorganic fiber sheet, or from both sides of the inorganic fiber sheet may be appropriately selected according to method for producing the inorganic fiber sheet, particularly to the inorganic fiber precursor sheet used for producing the inorganic fiber sheet.

Specifically, the inorganic fiber precursor forming the inorganic fiber precursor sheet is formed via a spinning step such as a blowing method and a spinning method. And in a case of a producing method wherein each of the inorganic fiber precursors are present as random in the thickness direction when an inorganic fiber precursor sheet is formed, the sampled inorganic fiber may be regarded as sufficiently representing the inorganic fiber sheet of the entire inorganic fiber sheet, even when the sampling section is placed only on one side of the inorganic fiber sheet. Therefore, it is also possible to place the sampling section only on one side of the inorganic fiber sheet. Incidentally, the spun inorganic fiber precursors being present as random in the thickness direction of the inorganic fiber precursor sheet, means that the inorganic fiber precursor, discharged from a certain spinning nozzle in the spinning step, is present at a probability density which is equally dispersed at any location in the in-plane direction and in the thickness direction of the inorganic fiber precursor sheet, without being always present at a certain location of the inorganic fiber precursor sheet.

Incidentally, when the inorganic fiber precursor is dispersed at equal probability in the thickness direction of the inorganic fiber precursor sheet, but the inorganic fiber precursor is not dispersed at equal probability in the in-plain direction of the inorganic fiber precursor sheet, it cannot be regarded as random. However, the collected fiber diameter measuring sample may be regarded as representing the entire inorganic fiber sheet, by carrying out the sampling of the inorganic fiber in the entire area in the in-plain direction of the inorganic fiber sheet with the sampling section, even when the sampling section is placed only on one side of the inorganic fiber sheet. Therefore, it is also possible to employ an aspect wherein the sampling section is placed only on one side of the inorganic fiber sheet.

Examples of the producing method wherein the spun inorganic fiber precursor is present as random in the thickness direction of the inorganic fiber precursor sheet, may include a producing method wherein a sheet-shape is formed after going through stacking by, for example, zigzag folding; and a producing method wherein the inorganic fiber precursor is stirred so as to be completely random, and then, stacked to form a sheet-shape.

Among them, when the sampled inorganic fiber shows the fiber diameter measurement result which may be regarded as representing the inorganic fiber sheet in the actual aspect wherein the sampling section is placed only on one side of the inorganic fiber sheet, it is preferable to employ the aspect wherein the sampling section is placed only on one side of the inorganic fiber sheet.

As described in the evaluation of the Example and Reference Examples below, representing in this case means that, when compared with the measurement sample prepared or adjusted from an inorganic fiber sheet by the conventional Die-cutting (preferably complying with COMMISSION REGULATION (EC) No. 761/2009 of 23 Jul. 2009) (hereinafter sometimes referred to as a conventional method fiber), the average fiber diameter of the inorganic fiber sampled in the actual aspect wherein the sampling section is placed only on one side of the inorganic fiber sheet (hereinafter sometimes referred to as a sampling method fiber) is in the range of the variation of the conventional method fiber (which may be a variation in the average fiber diameter of each of the divided inorganic fiber sheet prepared or adjusted after dividing the inorganic fiber sheet into a constant area, as in the Reference Example described below). This variation is preferably within ±3σ of the average value, more preferably within ±2σ of the average value, and more preferably within ±σ of the average value, when the standard deviation is regarded as σ (sigma), when the probability density distribution of the variation of the fiber diameter or the average fiber diameter of the conventional method fiber is a normal distribution. Similarly, in the case where the probability density distribution of the variation of the fiber diameter or the average fiber diameter of the conventional method fiber is not a normal distribution, it is preferable that the average fiber diameter of the sampling method fiber is present within 49.85% on each of the thick side and the thin side from the center (average value) of the existence probability of the fiber diameter or the average fiber diameter of the conventional method fiber, further preferably present within 47.70%, and more preferably present within 34.15%.

Meanwhile, when each of the inorganic fiber precursors are not present as random in the in-plane direction and in the thickness direction of the inorganic fiber precursor sheet when an inorganic fiber precursor sheet is formed, and the inorganic fiber precursors discharged from a specific spinning nozzle are present at a certain location of the inorganic fiber precursor sheet certainly or at high probability, the sampled inorganic fiber may be regarded as sufficiently representing the inorganic fiber sheet of the entire inorganic fiber sheet by placing the sampling section on both sides of the inorganic fiber sheet. Therefore, it is preferable to place the sampling section on both sides of the inorganic fiber sheet. Incidentally, when the inorganic fiber precursor is dispersed at equal probability in the in-plain direction of the inorganic fiber precursor sheet, but the inorganic fiber precursor is not dispersed at equal probability in the thickness direction of the inorganic fiber precursor sheet, there may be a case wherein the sampled fiber diameter measuring sample cannot be regarded as representing the entire inorganic fiber sheet, particularly unless the sampling sections are placed on both sides of the inorganic fiber sheet. Therefore, in this case, it is preferable to place the sampling sections on both sides of the inorganic fiber sheet, and collect the inorganic fiber from both sides of the inorganic fiber sheet.

However, this does not apply when the thickness of the inorganic fiber sheet is extremely thin, and the inorganic fiber representing the inorganic fiber sheet may be obtained without being affected by the bias of the probability density by going through a pretreating section configured to assist the sampling of the inorganic fiber. The case wherein the thickness of the inorganic fiber sheet is extremely thin, and the inorganic fiber representing the inorganic fiber sheet may be obtained without being affected by the bias of the probability density by going through a pretreating section configured to assist the sampling of the inorganic fiber, indicates a case wherein the sampled inorganic fiber shows the fiber diameter measurement result which may be regarded as representing the inorganic fiber sheet in the actual aspect wherein the sampling section is placed only on one side of the inorganic fiber sheet. The judging criterion for determining whether a fiber diameter measurement result may be regarded as representing the inorganic fiber sheet, or not is determined based on whether the variation is in the range similar to a case of determining whether the sampling section may be placed only on one side of the inorganic fiber sheet, or not in the sampling section described above, and the details thereof have been described above.

Also, for example, when a predetermined region of an end portion in a width direction of an inorganic fiber sheet is trimmed, the "entire area of the inorganic fiber sheet" includes an aspect wherein the entire region of the inorganic fiber sheet is an entire region of the inorganic fiber sheet after being trimmed.

A fiber diameter measuring device in the present disclosure are explained with reference to drawings. Incidentally, in the present descriptions, the same reference sign is indicated for the same factor in in description of the drawings, and duplicated explanation may be omitted in some cases.

FIG. 1 is a schematic diagram illustrating an example of the fiber diameter measuring device in the present disclosure. Fiber diameter measuring device 10 illustrated in FIG. 1 is an example of a fiber diameter measuring device configured to measure a fiber diameter of an inorganic fiber in a lengthy inorganic fiber sheet 1. As illustrated in FIG. 1, fiber diameter measuring device 10 comprises sampling section 2 capable of sampling a predetermined amount of the inorganic fiber in an entire area of the inorganic fiber sheet 1; and measuring section 3 configured to measure a fiber diameter of the sampled inorganic fiber. In the example illustrated in FIG. 1, the sampling section 2 is placed on the lower side of the inorganic fiber sheet 1. However, the arrangement of the sampling section 2 is not limited thereto, and may be placed on the upper side of the inorganic fiber sheet 1.

In the fiber diameter measuring device 10 illustrated in FIG. 1, the lengthy inorganic fiber sheet 1 is conveyed by conveyance rolls 11 and 12. Firstly, the sampling section 2 includes sample collecting section 2*c* such as a container having an upper opening, configured to collect the inorganic fiber from the lower side of the inorganic fiber sheet 1. At this time, the sampling section 2 preferably includes sample transferring section 2*a* configure to transfer the inorganic fiber in order to increase the amount of the inorganic fiber collected per unit time. Examples of the sample transferring section 2*a* may include, as will be described later, a suctioning section and a physical conveyance section. Among them, the suctioning section is preferable as the sample transferring section 2*a* because of its simplicity.

Hereinafter, in the fiber diameter measuring device 10 illustrated in FIG. 1, a case where the sampling section 2 includes a suctioning section as the sample transferring section 2*a*, and sample collecting section 2*c* is described.

In this case, in an area wherein the suctioning port of the sample transferring section 2*a* (suctioning section) is in contact with or proximity to the inorganic fiber sheet 1, inorganic fiber sample may be efficiently transferred from the inorganic fiber sheet 1 to the sample collecting section 2*c*. As the result, the inorganic fiber may be efficiently collected. Therefore, for example, by setting the width of the suctioning port of the sample transferring section 2*a* (suctioning section) to be equal to or larger than the width of the inorganic fiber sheet 1, or by transferring the sample transferring section 2*a* (suctioning section) relative to the inorganic fiber sheet 1, a predetermined amount of the inorganic fiber may be collected in the entire area of the inorganic fiber sheet 1.

Also, in the sample transferring section 2*a* (suctioning section), the inorganic fiber is collected by suctioning the inorganic fiber from the inorganic fiber sheet 1. Since it is not necessary to punch out or cut out the inorganic fiber sheet 1 for the sampling, the appearance of the inorganic fiber sheet 1 may be suppressed from being impaired. Then, the fiber diameter of the sampled inorganic fiber is measured by the measuring section 3. In the measuring section 3, the average fiber diameter, and fiber diameter distribution, for example, of the inorganic fiber diameter may be measured.

It is preferable to use an automated fiber diameter measuring device as the measuring section 3 since it is easy to continuously acquire the measurement results.

Also, in the fiber diameter measuring device in the present disclosure, the sampling section 2 preferably includes a pretreating section configured to assist the sampling of the inorganic fiber. Examples of the pretreating section may include a physically contactless section and a physical contacting section, as described below. Examples of the physically contactless section may include, as will be described later, a feeding section configured to feed a gas or a liquid to the inorganic fiber sheet, and a section configured to impart a vibration to the inorganic fiber sheet itself by feeding air, for example, intermittently. Examples of the physically contacting section may include, as will be described later, a section configured to bring a plate-shaped material, a brush-shaped material and a comb-shaped material into contact with the inorganic fiber sheet surface substantially horizontally; a section configured to pick the inorganic fiber up from the inorganic fiber sheet by a picking tool; and a section configured to vibrate a site in contact with the inorganic fiber sheet during conveyance. Among them, the feeding section and the vibration section are preferable as the pretreating section, as will be described later.

Hereinafter, a case where the sampling section includes a feeding section as the pretreating section, a sample collecting section, and a sample transferring section is described referring to FIG. 2. Also, a case where the sampling section includes a vibration section as the pretreating section, and a sample collecting section is described referring to FIG. 3.

Figure 2:
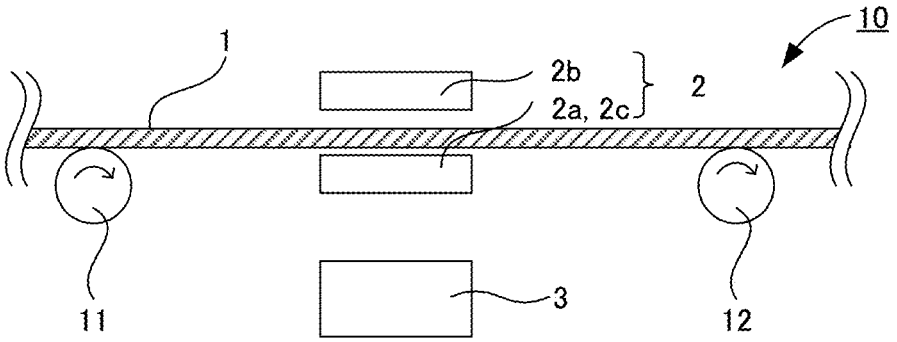
FIG. 2 is a schematic view illustrating another example of a fiber diameter measuring device in the present disclosure.

FIG. 2 is a schematic view illustrating another example of the fiber diameter measuring device in the present disclosure. In the example illustrated in FIG. 2, as the pretreating section, the sampling section 2 includes feeding section 2*b* configured to feed a gas such as air or a liquid such as water, to the inorganic fiber sheet 1, from the upper side of the inorganic fiber sheet 1, and further includes sample transferring section 2*a* configured to transfer the inorganic fiber included in the gas or the liquid, from the lower side of the inorganic fiber sheet 1, and sample collecting section 2*c*. In the example illustrated in FIG. 2, the sample transferring section 2*a* and the sample collecting section 2*c* are placed on the opposite side of the feeding section 2*b*. However, the arrangement of the sample transferring section 2*a* and the sample collecting section 2*c* is not limited thereto, and may be placed, for example, immediately after the feeding section 2*b*.

In the fiber diameter measuring device 10 illustrated in FIG. 2, firstly, a gas or liquid is fed from the upper side of the inorganic fiber sheet 1 by the feeding section 2*b*, so that the gas or the liquid is passed through in the thickness direction of the inorganic fiber sheet 1, and the gas or the liquid including the inorganic fiber is collected from the lower side of the inorganic fiber sheet 1 by the sample transferring section 2*a* and the sample collecting section 2*c*. As the result, the inorganic fiber is collected. At this time, the inorganic fiber may be collected from the inorganic fiber sheet 1 in the area where the gas or the liquid is fed to the inorganic fiber sheet 1. Therefore, for example, a predetermined amount of the inorganic fiber may be collected in the entire area of the inorganic fiber sheet 1 by feeding the gas or the liquid in the entire area in the width direction of the inorganic fiber sheet 1 by the feeding section 2*b*. Also, in the feeding section 2*b*, sample transferring section 2*a*, and sample collecting section 2*c*, the inorganic fiber is collected by passing the gas or liquid in the thickness direction of the inorganic fiber sheet 1, and it is not necessary to punch out or cut out the inorganic fiber sheet 1 for sampling, so that the appearance of the inorganic fiber sheet 1 may be suppressed from being impaired. The fiber diameter of the sampled inorganic fiber is then measured by the measuring section 3.

Figure 3:
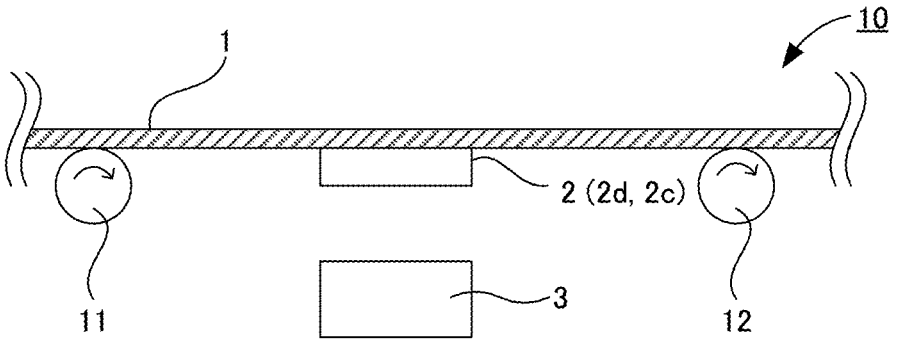
FIG. 3 is a schematic view illustrating another example of a fiber diameter measuring device in the present disclosure.

FIG. 3 is a schematic view illustrating another example of the fiber diameter measuring device in the present disclosure. In the example illustrated in FIG. 3, as the pretreating section, the sampling section 2 includes vibration section 2*d* placed on the lower side of the inorganic fiber sheet 1 that is configured to impart a vibration to the inorganic fiber sheet 1; and further includes sample collecting section 2*c* placed on the lower side of the inorganic fiber sheet 1 that is configured to collect the inorganic fiber sample dropped by the vibration. In the example illustrated in FIG. 3, the vibration section 2*d* is placed on the lower side of the inorganic fiber sheet 1. However, the arrangement of the vibration section 2*d* is not limited thereto, and may be placed on the upper side of the inorganic fiber sheet 1.

In the fiber diameter measuring device 10 illustrated in FIG. 3, firstly, a vibration is imparted to the inorganic fiber sheet 1 by the vibration section 2*d*, and the inorganic fiber dropped by the vibration is obtained by the sample collecting section 2*c*. At this time, the inorganic fiber may be collected from the inorganic fiber sheet 1 in the area where the vibration is imparted to the inorganic fiber sheet 1. Therefore, for example, a predetermined amount of the inorganic fiber may be collected in the entire area of the inorganic fiber sheet 1 by imparting the vibration to the entire area in the width direction of the inorganic fiber sheet 1 by the vibration section 2*d*. Also, the vibration section 2*d* and the sample collecting section 2*c* collect the inorganic fiber by imparting the vibration to the inorganic fiber sheet 1, and it is not necessary to punch out or cut out 1 the inorganic fiber sheet 1 for sampling, so that the appearance of the inorganic fiber sheet 1 may be suppressed from being impaired. The fiber diameter of the sampled inorganic fiber is then measured by the measuring section 3. Also, in the fiber diameter measuring device 10 illustrated in FIG. 3, the sampling section 2 may include the sample transferring section.

Incidentally, FIGS. 1 to 3 illustrate examples of the fiber diameter measuring device configured to measure the fiber diameter of the inorganic fiber in the lengthy inorganic fiber sheet 1. However, the fiber diameter measuring device in the present disclosure may be a fiber diameter measuring device configured to measure the fiber diameter of the inorganic fiber in a single sheet shaped inorganic fiber sheet.

According to the present disclosure, since a predetermined amount of the inorganic fiber may be sampled in the entire area of the inorganic fiber sheet in sampling section, the sampled inorganic fiber may be regarded as representing the inorganic fiber in the inorganic fiber sheet. Therefore, by using the fiber diameter measuring device in the present disclosure, it is capable of guaranteeing continuous safeness of the fiber diameter of an inorganic fiber in an inorganic fiber sheet, and it is possible to improve the reliability of the average fiber diameter and the fiber diameter distribution, for example, of the measured inorganic fiber. For example, in a case of a lengthy inorganic fiber sheet, it is possible to guarantee the average fiber diameter and the fiber diameter distribution, for example, of the inorganic fiber in the entire area of the sheet. Therefore, a safer inorganic fiber sheet may be provided.

Also, according to the present disclosure, since the sampling section is a section capable of sampling a predetermined amount of the inorganic fiber in the entire area of the inorganic fiber sheet, the fiber diameter of the inorganic fiber in the inorganic fiber sheet may be measured without punching out or cutting out the inorganic fiber sheet for sampling. Therefore, the fiber diameter of the inorganic fiber in the inorganic fiber sheet may be measured, not only after the production of the inorganic fiber sheet but also during the production of the inorganic fiber sheet. That is, the fiber diameter of the inorganic fiber in the inorganic fiber sheet may be measured on-line. Therefore, the average fiber diameter and the fiber diameter distribution, for example, of the inorganic fiber in the inorganic fiber sheet may be controlled on-line. The variation of the average fiber diameter and the fiber diameter distribution, for example, of the inorganic fiber and deviation from acceptable range may also be checked on-line. Therefore, by feeding the result back to the production process, for example, of the inorganic fiber sheet, and controlling the production conditions of the inorganic fiber sheet, the average fiber diameter and the fiber diameter distribution, for example, of the inorganic fiber may be kept in an acceptable range.

According to the present disclosure, since the sampling section is a section wherein a predetermined amount of the inorganic fiber may be sampled in the entire area of the inorganic fiber sheet, and since the inorganic fiber sheet is not punched out or cut out, the physical properties and the appearance of the inorganic fiber sheet used for the measuring may be suppressed from being greatly impaired. For example, when measuring the fiber diameter of an inorganic fiber in an inorganic fiber sheet subjected to a needling treatment, it is particularly important that the inorganic fiber sheet subjected to a needling treatment does not defect the vertical bundles composed of the inorganic fibers, since the vertical bundles composed of the inorganic fibers configured to bind short fibers in the thickness direction play a significant role in ensuring the physical properties and appearance. By using the fiber diameter measuring device in the present disclosure, an inorganic fiber sheet having good physical properties and appearance even after the measurement of the fiber diameter may be obtained, and it may be used as a product as it is.

Hereinafter, the inorganic fiber sheet in the present disclosure and each constitution of the fiber diameter measuring device in the present disclosure will be described.

1. Inorganic Fiber Sheet

The inorganic fiber sheet in the present disclosure includes an inorganic fiber. The inorganic fiber sheet is referred to as, for example, a mat or a blanket.

The inorganic fiber constituting the inorganic fiber sheet is not particularly limited, and, for example, one or more selected from alumina fiber, ceramic fiber, biosoluble fiber (alkaline earth silicate fiber), rock wool, basalt fiber, potassium titanate fiber, calcium silicate fiber and glass fiber, may be used. The inorganic fiber is preferably one or more selected from alumina fiber, ceramic fiber, biosoluble fiber (alkaline earth silicate fiber), and basalt fiber. Also, examples of the inorganic fiber may include a simplex or complex fiber such as silica, alumina/silica, and zirconia, spinel, titania and calcia including these. Among them, alumina/silica fiber including alumina and silica as main components is preferable, and particularly preferably a crystalline alumina/silica fiber. Although the ratio of aluminum and silicon is not particularly limited, the ratio is preferably in a range of 60:40 to 98:2, more preferably in a range of 65:35 to 95:5, and particularly preferably in a range of 70:30 to 80:20, converted to $Al_2O_3/SiO_2$ mass ratio.

The inorganic fiber is preferably a short fiber. This is because the toughness may be enhanced without impairing the thickness of the inorganic fiber sheet. Also, when the inorganic fiber is a short fiber, safety may be a problem.

Incidentally, the inorganic fiber being a short fiber means, for example, that the average fiber length of the inorganic fiber is 1000 mm or less. Also, when the inorganic fiber is a short fiber, the average fiber length of the inorganic fiber may be in a range of, for example, 210 μm or more and 1000 μm or less.

The average fiber diameter of the inorganic fiber is not particularly limited, and is preferably, for example, 3 μm or more and 15 μm or less, more preferably 4 μm or more and 13 μm or less, further preferably 5 μm or more and 10 μm or less, and particularly preferably 5 μm or more and 8 μm or less. This is because the repulsive force and toughness of the inorganic fiber are improved, and the strength of the fiber may be increased. Incidentally, when the average fiber diameter of the inorganic fiber is too long, the normal temperature compressive cycling property (cold compression) of the inorganic fiber sheet is lost, and meanwhile, when the average fiber diameter is too short, the amount of fibrous material that reaches the lung when inhaled might be increased.

The inorganic fiber sheet is preferably subjected to a needling treatment. As described above, in the inorganic fiber sheet subjected to a needling treatment, particularly, since the vertical bundles composed of the inorganic fibers configured to bind fibers in the thickness direction play a significant role in ensuring the physical properties and appearance, it is important that the vertical bundles composed of the inorganic fibers are not defected. Since the physical properties and the appearance of the inorganic fiber sheet used for the measuring may be suppressed from being greatly impaired, the present disclosure is useful for measuring the fiber diameter of the inorganic fiber sheet subjected to a needling treatment.

The inorganic fiber sheet subjected to a needling treatment has a plurality of needle marks, that is, a plurality of recesses. The needle mark may be a through hole which penetrates through in the thickness direction of the inorganic fiber sheet, and may be a non-through hole which does not penetrate through the sheet.

The number of the needle marks per unit area of the inorganic fiber sheet (hereinafter referred to as needle mark density) is not particularly limited, and the larger the needle mark density, the higher the shear force, whereas the surface pressure decreases, and the smaller the needle mark density, the larger the surface pressure, whereas the shear force decreases. Therefore, the needle mark density is preferably to the extent that the shear force and the surface pressure are in good balance. The needle mark density may be, for example, 1.0 piece/$cm^2$ or more and 50.0 pieces/$cm^2$ or less.

Here, the number of needle marks may be the number of white spots projected onto another surface of the inorganic fiber sheet when one surface of the inorganic fiber sheet is exposed to visible light. Incidentally, the white spot may be confirmed regardless of whether the needle mark is a through hole or a non-through hole.

The needle mark may be provided at equal intervals in plan view, and may be provided at random. The average distance between two adjacent needle marks may be, for example, 0.1 cm or more and 4 cm or less.

Also, the inorganic fiber sheet may be a papermaking sheet.

The average thickness of the inorganic fiber sheet is not particularly limited, and may be appropriately set depending on the application, for example.

The inorganic fiber sheet may be lengthy, and may be single sheet shape. Among them, the lengthy inorganic fiber sheet is preferable. Since the fiber diameter of the inorganic fiber in the inorganic fiber sheet may be measured on-line, the present disclosure is useful for the lengthy inorganic fiber sheet.

Incidentally, since method for producing an inorganic fiber sheet is described in "D. Method for producing inorganic fiber sheet" later, description thereof will be omitted here.

2. Sampling Section

The sampling section in the present disclosure is a section capable of sampling a predetermined amount of the inorganic fiber in the entire area of the inorganic fiber sheet.

Any sampling section will do as long as it is a section capable of sampling a predetermined amount of the inorganic fiber in the entire area of the inorganic fiber sheet, and for example, it may be a section capable of sampling a predetermined amount of the inorganic fiber in the entire area in the in-plane direction of the inorganic fiber sheet; and it may be a section capable of sampling a predetermined amount of the inorganic fiber in the entire area in the in-plane direction and in the thickness direction of the inorganic fiber sheet. Among them, as described above, a section capable of sampling a predetermined amount of the inorganic fiber representing the whole of the inorganic fiber sheet in the entire area of the inorganic fiber sheet is preferable. The reason therefor is to improve the reliability of the fiber diameter.

Examples of the sampling section may include a section capable of sampling a predetermined amount of the inorganic fiber in the entire area of the inorganic fiber sheet without significantly impairing the physical properties and appearance of the inorganic fiber sheet. As described above, since good appearance is required for the inorganic fiber sheet subjected to a needling treatment, the sampling section is preferably a section not significantly impairing the appearance of the inorganic fiber sheet.

Also, when the inorganic fiber is sampled from the inorganic fiber sheet by the sampling section, it is only necessary to sample a predetermined amount of the inorganic fiber in the entire area of the inorganic fiber sheet, and for example, the inorganic fiber may be sampled from one side of the inorganic fiber sheet, and the inorganic fiber may be sampled from both sides of the inorganic fiber sheet.

The sampling of the inorganic fiber may be carried out continuously and may be carried out intermittently. Among them, the sampling of the inorganic fiber is preferably carried out continuously. The reason therefor is to improve the reliability of the fiber diameter.

Also, in the sampling section, a predetermined amount of the inorganic fiber is sampled in the entire area of the inorganic fiber sheet. At this time, the amount of the inorganic fiber to be sampled may be equal to or more than an amount necessary for measuring the fiber diameter of the inorganic fiber. When more than the necessary amount of the inorganic fiber is sampled, the amount may be optimized to an amount necessary for measurement by a reducing method.

Also, the inorganic fiber naturally dropped from the inorganic fiber sheet may be included in the sampled inorganic fiber.

(1) Sample Collecting Section

The sampling section in the present disclosure may include a sample collecting section configured to collect the inorganic fiber. The sample collecting section includes, for example, a container with an opening. Specifically, as the sample collecting section, a container, for example, placed on the upper side, the lower side, or the side surface of the inorganic fiber sheet, and has an opening on an upper side and/or a lower side and/or a side surface may be used; and if necessary, the sample transferring section described later may be used.

The sample collecting section may be placed on any of the upper, lower, and side surfaces of the inorganic fiber sheet.

Also, the sample collecting section may be placed so as to be in contact with or proximity to the upper side or the lower side of the inorganic fiber sheet. Among them, when the sample transferring section described later is not used, the sample collecting section is preferably placed so as to be in contact with or proximity to the upper side or the lower side of the inorganic fiber sheet. This is for preventing dust, floating fiber, for example, in an atmosphere from mixing into the inorganic fiber when the inorganic fiber naturally dropped from the inorganic fiber sheet is collected. Particularly, when the sample transferring section is not used, the sample collecting section is preferably placed so as to be proximity to the upper side or the lower side of the inorganic fiber sheet. The reason therefor is to suppress the appearance of the inorganic fiber sheet from being impaired by the sample collecting section being in contact with the inorganic fiber sheet. In this case, it is preferable that the sample collecting section is placed at a constant distance from the surface of the inorganic fiber sheet.

Also, as will be described later, when the sampling section in the present disclosure includes a pretreating section configured to assist the sampling of the inorganic fiber, and uses feeding section configured to feed a gas such as air or a liquid such as water to the inorganic fiber sheet as the pretreating section, the feeding section is a section configured to feed a gas or a liquid from one side or both sides of the inorganic fiber sheet, and the sample collecting section is a section configured to collect a fiber or a gas or a liquid including the inorganic fiber from the same side or the opposite to the side wherein the feeding section of the inorganic fiber sheet is placed, or from both sides of the inorganic fiber sheet.

When the feeding section is a gas feeding section, the sample collecting section may be any section capable of collecting the inorganic fiber from either the same side as the side of the inorganic fiber sheet wherein the feeding section is placed (such as the upper side of the inorganic fiber sheet, when the feeding section is placed on the upper side of the inorganic fiber sheet), or the opposite side (such as the lower side of the inorganic fiber sheet, when the feeding section is placed on the upper side of the inorganic fiber sheet), or both sides of the inorganic fiber sheet, and for example, a container for receiving the inorganic fiber is used.

When the feeding section is a liquid feeding section, the sample collecting section may be any section capable of collecting the liquid including the inorganic fiber, from either the same side of the inorganic fiber sheet as the side wherein the feeding section is placed (such as the upper side of the inorganic fiber sheet, when the feeding section is placed on the upper side of the inorganic fiber sheet), or the opposite side (such as the lower side of the inorganic fiber sheet, when the feeding section is placed on the upper side of the inorganic fiber sheet), or both sides of the inorganic fiber sheet, and for example, a container for receiving the liquid including the inorganic fiber is used.

Also, as described later, when the sampling section in the present disclosure includes the pretreating section, and a section configured to bringing a plate-shaped material, a brush-shaped material, and a comb-shaped material (hereinafter, sometimes referred to as a plate-shaped material and the like) into substantially horizontally contact with the inorganic fiber sheet surface, is used as the pretreating section, the sample collecting section is a section configured to collect the inorganic fiber generated by the contact of the plate-shaped material and the like with the inorganic fiber sheet. Among them, when a plate-shaped material and the like is placed on the lower side of the inorganic fiber sheet as a pretreating section, the sample collecting section may be a section configured to collect the inorganic fiber dropped by the contact of the plate-shaped material and the like with the inorganic fiber sheet.

When a section configured to bringing a plate-shaped material and the like into substantially horizontal contact with the inorganic fiber sheet surface is used as the pretreating section, any section capable of collecting an inorganic fiber generated or dropped by the contact of the plate-shaped material and the like with the inorganic fiber sheet, may be used as the sample collecting section, and for example, a container receiving an inorganic fiber, for example, is used. In this case, the sample collecting section may be used together with the sample transferring section described later.

When a section configured to bring a plate-shaped material and the like into substantially horizontal contact with the inorganic fiber sheet surface is used as the pretreating section, when a plate-shaped material and the like is placed on the lower side of the inorganic fiber sheet, the sample collecting section is usually placed on the lower side of the inorganic fiber sheet. However, this is not the case when the sample transferring section described later is used.

As will be described later, when the sampling section in the present disclosure includes a pretreating section, and when the vibration section configured to impart a vibration to the inorganic fiber sheet is used as the pretreating section, the sample collecting section may be any section capable of collecting the inorganic fiber dropped by the vibration, and for example, a container for receiving the inorganic fiber, for example, is used.

When the vibration section is used as the pretreating section, the sample collecting section is usually placed on the lower side of the inorganic fiber sheet. However, this is not the case when the sample transferring section described later is used.

(2) Sample Transferring Section

The sampling section in the present disclosure may include a sample transferring section placed on one side or both sides of the inorganic fiber sheet, and configured to transfer the inorganic fiber. By including the sample transferring section, the amount of the inorganic fiber collected per unit time may be increased.

Examples of the sample transferring section may include: a suctioning section; and physically conveyance section such as a section configured to transfer the inorganic fiber in the vicinity of the inorganic fiber sheet surface, by a conveyance device such as a belt conveyor and a section configured to transfer tweezers those have picked the inorganic fiber, and releasing the tweezers, thereby transferring the inorganic fiber to the sample collecting section.

The sample transferring section may be placed on one side of the inorganic fiber sheet, and may be placed on both sides of the inorganic fiber sheet. Also, when the sample transferring section is placed on one side of the inorganic fiber sheet, it may be placed on the upper side of the inorganic fiber sheet, and may be placed on the lower side of the inorganic fiber sheet.

Also, the sample transferring section may be placed so as to be in contact with or proximity to one side or both sides of the inorganic fiber sheet. Among them, it is preferable that the sample transferring section is placed so as to be proximity to one side or both sides of the inorganic fiber sheet. The reason therefor is to suppress the appearance of the inorganic fiber sheet from being impaired by the contact of the sample transferring section with the inorganic fiber sheet. In this case, it is preferable that sample transferring section is placed at a constant distance from one side or both sides of the inorganic fiber sheet.

Also, as will be described later, when the sampling section in the present disclosure includes the pretreating section, and the feeding section is used as the pretreating section, the sampling section preferably includes a sample transferring section in order to efficiently collect the inorganic fiber.

When the feeding section is a gas feeding section, the sample transferring section may be any section capable of transferring the inorganic fiber, and for example, the suctioning section and physically conveyance section may be used.

When the feeding section is a liquid feeding section, the sample transferring section may be any section capable of transferring a liquid including the inorganic fiber, and for example, the suctioning section may be used.

Also, as will be described later, when the sampling section in the present disclosure includes a pretreating section, and a section configured to bringing a plate-shaped material and the like into substantially horizontally contact with the inorganic fiber sheet surface, is used as the pretreating section, the sampling section preferably includes the sample transferring section.

When a section configured to bringing a plate-shaped material and the like into substantially horizontal contact with the inorganic fiber sheet surface is used as the pretreating section, the sample transferring section may be any section capable of transferring the inorganic fiber, and for example, the suctioning section and physically conveyance section may be used.

When a section configured to bring a plate-shaped material and the like into substantially horizontal contact with the inorganic fiber sheet surface is used as the pretreating section, the sample transferring section is usually placed on the same side of the inorganic fiber sheet, as the side wherein the pretreating section is placed. Incidentally the arrangement of the sample transferring section is as described above.

Also, as will be described later, when the sampling section in the present disclosure includes a pretreating section configured to assists in the sampling of the inorganic fiber, and the vibration section is used as the pretreating section, the sampling section preferably includes a sample transferring section in order to efficiently collect the inorganic fiber.

When the vibration section is used as the pretreating section, the sample transferring section may be any section capable of transferring the inorganic fiber, and for example, the suctioning section and physically conveyance section may be used.

When the vibration section is used as the pretreating section, the sample transferring section is usually placed only on the lower side or on both sides of the inorganic fiber sheet. This is because, when the vibration section is used, it is necessary to collect the inorganic fiber dropped from the inorganic fiber sheet. Incidentally the arrangement of the sample transferring section is as described above.

(2-1) Suctioning Section

Among the above, a suctioning section is preferable as the sample transferring section since it is simple.

The suctioning section is placed on one side or both sides of the inorganic fiber sheet, and is a section configured to suction the inorganic fiber.

The suctioning section may be placed on one side of the inorganic fiber sheet, and may be placed on both sides of the inorganic fiber sheet. Also, when the suctioning section is placed on one side of the inorganic fiber sheet, it may be placed on the upper side of the inorganic fiber sheet, and may be placed on the lower side of the inorganic fiber sheet. When the suctioning section is placed on the lower side of the inorganic fiber sheet, the distance between the inorganic fiber sheet and the suctioning section may be set to a constant distance regardless of the thickness of the inorganic fiber sheet to be measured. Meanwhile, when the suctioning section is placed on the upper side of the inorganic fiber sheet, the collection of dust, for example, may be suppressed.

Also, the suctioning section is placed so as to be in contact with or proximity to one side or both sides of the inorganic fiber sheet. In this case, the suctioning section is preferably placed at a constant distance from one side or both sides of the inorganic fiber sheet. The reason therefor is to always collect the inorganic fiber at a constant suctioning force, by keeping a constant distance in the thickness direction. Also, in this case, the constant distance may be zero, in other words, the suctioning section may be in contact with one side or both sides of the inorganic fiber sheet. Among them, the suctioning section is preferably placed so as to be proximity to one side or both sides of the inorganic fiber sheet. The reason therefor is to suppress the following defects due to the suctioning section being in contact with the inorganic fiber sheet: the appearance of the inorganic fiber sheet may be suppressed from being impaired; the physical properties may be suppressed from being deteriorated due to the bend of the inorganic fiber sheet in the suctioning direction; and the possibility of foreign matter such as dust being mixed by the suctioning section may be decreased.

The output of the suctioning section is not particularly limited as long as it is capable of suctioning the inorganic fiber without significantly impairing the appearance of the inorganic fiber sheet.

The size of the suctioning section is not particularly limited as long as a predetermined amount of the inorganic fiber may be collected in the entire area of the inorganic fiber sheet, and the inorganic fiber may be suctioned without significantly impairing the appearance of the inorganic fiber sheet. For example, the width of the suctioning port of the suctioning section may be equal to or more than the width of the inorganic fiber sheet, and may be less than the width of the inorganic fiber sheet. Among them, the width of the suctioning port of the suctioning section is preferably equal to or more than the width of the inorganic fiber sheet. The reason therefor is to collect the inorganic fiber uniformly in the width direction of the inorganic fiber sheet. Meanwhile, even when the width of the suctioning port of the suctioning section is less than the width of the inorganic fiber sheet, a predetermined amount of the inorganic fiber may be collected in the entire area of the inorganic fiber sheet, by transferring the suctioning section relative to the inorganic fiber sheet, as described later. When the width of the suctioning port of the suctioning section is small, the suctioning force may be increased, and collection of dust, for example, may be suppressed.

Here, for example, when a predetermined region of an end portion in the width direction of the inorganic fiber sheet is trimmed, the width of the suctioning port of the suctioning section being equal to or more than the width of the inorganic fiber sheet includes an aspect wherein the width of the suctioning port of the suctioning section is equal to or more than the width of the inorganic fiber sheet after trimming.

The suctioning section may be fixed at arbitrary position, and may be movably placed at arbitrary position. When the suctioning section is movably placed, the suctioning section may be movable in any of the width direction, longitudinal direction, and thickness direction of the inorganic fiber sheet. For example, when the suctioning section is movable in the width direction of the inorganic fiber sheet, the inorganic fiber may be uniformly collected in the width direction of the inorganic fiber sheet. Specifically, it is only necessary to reciprocate the suctioning section in the entire width direction of the inorganic fiber sheet. Also, for example, when the suctioning section is movable in the thickness direction of the inorganic fiber sheet, when the suctioning section is placed on the upper side of the inorganic fiber sheet, the distance between the inorganic fiber sheet and the suctioning section may be set to a predetermined distance in accordance with the thickness of the inorganic fiber sheet to be measured.

Specifically, a dust collector may be used as the suctioning section.

The suction of the inorganic fiber may be carried out continuously, and may be carried out intermittently. Among them, the suction of the inorganic fiber is preferably carried out continuously. The reason therefor is to improve the reliability of the fiber diameter.

(3) Pretreating Section

The sampling section in the present disclosure may include a pretreating section configured to assist the sampling of the inorganic fiber.

The pretreating section is not particularly limited as long as it is a section configured to assisting the sampling of the inorganic fiber, and is preferably a section which does not significantly impair the physical properties and appearance of the inorganic fiber sheet. Specifically, the section is preferably a section wherein the vertical bundles composed of the inorganic fibers configured to bind fibers in the thickness direction, generated in the needling step, are less likely to be damaged.

The pretreating section is placed on one side or both sides of the inorganic fiber sheet, and is preferably placed on the periphery of the sample collecting section. Also, for example, the pretreating section may be placed on one side of the inorganic fiber sheet, and the sample collecting section may be placed on the other side. Also, for example, the pretreating section may be placed on one side of the inorganic fiber sheet, and the sample collecting section may be placed on the same side thereof. Also, for example, the pretreating section may be placed on both sides of the inorganic fiber sheet, and the sample collecting section may be placed on the same side thereof.

The pretreating section is not particularly limited as long as it is a section configured to assist the sampling of the inorganic fiber, and examples thereof may include a physically contactless section configured to be physically contactless with the inorganic fiber sheet; and a physically contacting section configured to be in physically contact with the inorganic fiber sheet. Also, the physically contactless section and the physical contacting section may be used in a combination.

(3-1) Physically Contactless Section

The physically contactless section is not particularly limited as long as it is physically contactless with the inorganic fiber sheet, and assists the sampling of the inorganic fiber. Among the above, for example, a feeding section configured to feed a gas such as air or a liquid such as water to the inorganic fiber sheet; and a section configured to feed air intermittently, for example, so as to vibrate the inorganic fiber sheet itself, are preferable. The physically contacting section may be a single section described above, or may be a combination thereof.

Incidentally, the section configured to feed air intermittently, for example, so as to vibrate the inorganic fiber sheet itself is one of the vibration sections described later. The vibration section will be described later.

(3-1-1) Feeding Section

The feeding section is a section configured to feed a gas such as air or a liquid such as water to the inorganic fiber sheet, from one side or both sides of the inorganic fiber sheet.

As the gas, for example, air, vapor, carbon dioxide, and nitrogen may be used. Among them, air is preferable from the viewpoint of safety and being a gas at normal temperature and normal pressure. One kind of gas may be used alone, and two or more kinds thereof may be mixed and used.

Also, the boiling point of the liquid is preferably 120° C. or less, and more preferably in a range of 60° C. or more and 110° C. or less. The reason therefor is to easily remove the liquid by setting the boiling point of the liquid in the above range. Meanwhile, when the boiling point is too high, it becomes difficult to completely remove the liquid. Also, when the boiling point is too low, the evaporation rate of the liquid becomes high, and it becomes difficult to sufficiently permeate the liquid into the inorganic fiber sheet so that it may be difficult to collect the liquid including the inorganic fiber.

The vapor pressure of the liquid at room temperature (25° C.) is preferably relatively low, and specifically preferably 5 kPa or less. When the vapor pressure is too high, the evaporation rate of the liquid becomes high, and it becomes difficult to sufficiently penetrate the liquid into the inorganic fiber sheet so that it may be difficult to collect the liquid including the inorganic fiber.

The viscosity of the liquid is preferably relatively low, and specifically, is preferably 3.5 mPa·s or less. When the viscosity of the liquid is low, the liquid tends to be impregnated into inorganic fiber sheet, so that the liquid including the inorganic fiber may be easily collected. Meanwhile, when the viscosity of the liquid is too high, it may be difficult to sufficiently penetrate the liquid into the inorganic fiber sheet so that it may be difficult to collect the liquid including the inorganic fiber.

Here, the viscosity refers to a viscosity at 20° C., and is a value measured using a rotary viscometer complying with JIS Z8803 (a method for measuring viscosity of a liquid).

The liquid is not particularly limited as long as it penetrates into the inorganic fiber sheet, and is preferably one which satisfies the above boiling point and viscosity. Examples of such a liquid may include water, and lower alcohols such as ethanol. Among them, water is preferable. Water is also suitable from an environmental point of view. As the water, for example, pure water may be used. One kind of the liquid may be used alone, and two or more kinds thereof may be mixed and used.

The gas feeding section is not particularly limited as long as the gas may be uniformly fed to the inorganic fiber sheet without significantly impairing the appearance of the inorganic fiber sheet. Examples thereof may include a section configured to blow a gas to the inorganic fiber sheet. Also, the feed of gas may be carried out continuously, and may be carried out intermittently. Among them, the feed of the gas is preferably carried out continuously. The reason therefor is to improve the reliability of the fiber diameter.

The liquid feeding section is not particularly limited as long as the liquid may be uniformly fed to the inorganic fiber sheet without significantly impairing the appearance of the inorganic fiber sheet. Examples thereof may include a section configured to apply or spray a liquid to the inorganic fiber sheet. Among them, the liquid feeding section is preferably a contactless method. The reason therefor is to suppress the appearance of the inorganic fiber sheet from being impaired. Also, the feed of the liquid may be carried out continuously, and may be carried out intermittently. Among them, the feed of the liquid is preferably carried out continuously. The reason therefor is to improve the reliability of the fiber diameter.

Also, as a gas or liquid feeding section, a fluid jet device configured to blow a fluid such as a gas such as vapor and a liquid such as water may be used, as long as the appearance of the inorganic fiber sheet is not significantly impaired. Examples of the fluid jet device may include a steam jet device, and a water jet device. When the feeding section is a fluid jet device, it may also function as a needling section configured to carry out a needling treatment to the inorganic fiber precursor sheet or the inorganic fiber sheet, to be described later.

The amount and pressure of the gas to be fed are not particularly limited as long as the gas may be uniformly fed to the inorganic fiber sheet without significantly impairing the appearance of the inorganic fiber sheet, and the inorganic fiber may be collected by the sample collecting section, and are appropriately selected according to the thickness, for example, of the inorganic fiber sheet.

The amount and the pressure of the liquid to be fed are not particularly limited as long as the liquid may be uniformly fed to the inorganic fiber sheet without significantly impairing the appearance of the inorganic fiber sheet, and the liquid including the inorganic fiber may be collected by the sample collecting section, and is appropriately selected according to the thickness, for example, of the inorganic fiber sheet.

(3-2) Physically Contacting Section

The physically contacting section is not particularly limited as long as it is a section configured to be in physically contact with the inorganic fiber sheet, and assist the sampling of the inorganic fiber. Examples of the physically contacting section may include a section configured to bring a plate-shaped material such as spatula using metals, resins, ceramics, and rubbers, for example, a brush-shaped material such as a brush, and a comb-shaped material such as a comb into contact with the inorganic fiber sheet surface substantially horizontally; a section configured to pick the inorganic fiber up from the inorganic fiber sheet by a picking tool such as tweezers; and a section configured to vibrate the contacting site with the inorganic fiber sheet during conveyance. The physically contactless section may be a single section described above, and may be a combination of the sections described above.

Among them, the physically contacting section is preferably a section configured to bring a plate-shaped material such as spatula, a brush-shaped material such as a brush, and a comb-shaped material such as a comb into contact with the inorganic fiber sheet surface substantially horizontally; and a section configured to vibrate the contacting site with the inorganic fiber sheet during conveyance.

Incidentally, a section configured to vibrate the contacting site with the inorganic fiber sheet during conveyance is one of the vibration sections described later. The vibration section will be described later.

(3-2-1) Section Configured to Bring Plate-Shaped Material and the Like into Contact with Inorganic Fiber Sheet Surface Substantially Horizontally A plate-shaped material such as spatula, a brush-shaped material such as a brush, and a comb-shaped material such as a comb (hereinafter, may be referred to as a plate-shaped material and the like) scrapes the inorganic fiber on the surface and in the vicinity of the surface of the inorganic fiber sheet by bringing them into contact with the surface of the inorganic fiber sheet substantially horizontally.

The plate-shaped material and the like is not particularly limited as long as it may collect the inorganic fiber by being in contact with the surface of the inorganic fiber sheet; and a plate-shaped material such as a spatula, a brush-shaped material such as a brush, and a comb-shaped material such as a comb, for example, may be used.

Examples of the material of the plate-shaped material and the like may include metal, resin, ceramic, and rubber.

When the inorganic fiber is collected using a plate-shaped material and the like, it is preferable that a plate-shaped material and the like is brought into substantially horizontally contact with the inorganic fiber sheet so as not to impair the appearance of the inorganic fiber sheet.

The plate-shaped material and the like may be placed on the lower or upper side of the inorganic fiber sheet, and may be placed on both sides thereof.

(3-3) Vibration Section

As the pretreating section, a vibration section may be used as the physically contactless section, and a vibration section may be used as the physical contacting section.

The vibration section is a section configured to impart a vibration to the inorganic fiber sheet. The vibration section is preferable in that the inorganic fiber inside the inorganic fiber sheet may be moved to the surface or in the vicinity of the surface of the inorganic fiber sheet. Also, the vibration section may be expected to have an effect of moving the short fiber inside the inorganic fiber sheet to the surface or in the vicinity of the surface of the inorganic fiber sheet so as to be easily collected.

The vibration section is not particularly limited as long as it may impart a vibration to the inorganic fiber sheet without significantly impairing the appearance of the inorganic fiber sheet; and examples thereof may include a section configured to vibrate the inorganic fiber sheet itself by feeding air, for example, intermittently; and a section configured to vibrate a contacting site with the inorganic fiber sheet during conveyance. Incidentally, as described above, the section configured to vibrate the inorganic fiber sheet itself by feeding air, for example, intermittently is included in the physically contactless section, and the section configured to vibrate a contacting site with the inorganic fiber sheet during conveyance is included in the physically contacting section.

Examples of the section configured to vibrate the inorganic fiber sheet itself by feeding air, for example, intermittently may include a vibration generating section configured to generate a vibration; and a blower section configured to blow air to the inorganic fiber sheet. Specific examples of the vibration generating section may include an ultrasonic vibration section, and a motor.

Example of the section configured to vibrate a contacting site with the inorganic fiber sheet during conveyance may include a shaking section configured to shake a contacting site with the inorganic fiber sheet, such as a conveyance device such as a conveyance roll or a conveyance conveyor configured to convey the inorganic fiber sheet, and a substrate which supports the inorganic fiber sheet; and a section configured to vibrate the inorganic fiber sheet by bringing a member different from the conveyance device into contact with the inorganic fiber sheet. Specifically, an ultrasonic vibration section, and a motor, for example, may be used as the shaking section. Also, as member different from the conveyance device described above, a pole, and a duster, for example, may be used.

The vibration may be imparted continuously or intermittently. Among them, the vibration is preferably imparted continuously. The reason therefor is to improve the reliability of the fiber diameter.

The magnitude and frequency of the vibration are not particularly limited as long as they are to the extent that the vibration may be imparted to the inorganic fiber sheet without significantly impairing the appearance of the inorganic fiber sheet; and the inorganic fiber may be collected by the vibration, and are appropriately selected.

The vibration section may be placed on one side or both sides of the inorganic fiber sheet. When the vibration section is used as the pretreating section, since the inorganic fiber may fall off from the inorganic fiber sheet surface due to the vibration caused by the vibration section, it is preferable that the vibration section is placed in the vicinity of or at the same position as the sample collecting section. However, this is not the case when the sample transferring section is used.

When the vibration section is a vibration generating section, the vibration generating section may be placed on either of the upper side or the lower side of the inorganic fiber sheet.

Also, when the vibration section is a blower section, the blower section may be placed on any of the upper side, the lower side, and the side surface of the inorganic fiber sheet. Among them, the blower section is preferably placed on the upper side of the inorganic fiber sheet, and in this case, it may also function as the feeding section.

(3-4) Preferable Embodiment of Pretreating Section

The feeding section and the vibration section are particularly preferable as the pretreating section. This is because the inorganic fiber may be collected without significantly impairing the appearance of the inorganic fiber sheet. Also, when the sampling section includes the feeding section or the vibration section as the pretreating section, the sampling section may be a section capable of collecting a predetermined amount of the inorganic fiber in the entire area in the in-plane direction and the thickness direction of the inorganic fiber sheet. In this case, the reliability of the fiber diameter may be improved.

(4) Image Capturing Section

The sampling section in the present disclosure may include an image capturing section configured to capture an image of the inorganic fiber collected from the inorganic fiber sheet. Common measures for acquiring an image may be applied as the image capturing section; and examples thereof may include a camera such as a CCD camera and a CMOS camera. In the image capturing section, for example, an image of an inorganic fiber collected by the sample collecting section may be acquired; and an image of an inorganic fiber may be acquired not via the sample collecting section. Therefore, when the sampling section includes the image capturing section, it may or may not include a sample collecting section. Also, when the sampling section includes the image capturing section, the measuring section described later may be a section wherein the measurement is carried out by an image analysis.

(5) Preferable Embodiment of Sampling Section

As the sampling section, the sample transferring section or the pretreating section may be used alone, and the sample transferring section and the pretreating section may be used in combination. Also, the sample transferring section may be a single section of each of the sections described above, and may be a combination of each of the sections described above. Similarly, the pretreating section may be a single section of each of the sections described, and may be a combination of each of the sections described above.

Among them, the sampling section preferably includes the sample transferring section and/or the pretreating section, and particularly preferably includes the suctioning section as sample transferring section and/or includes the feeding section or the vibration section as the pretreating section. The reason therefore is that, in these sampling sections, the inorganic fiber may be collected without significantly impairing the appearance of the inorganic fiber sheet.

3. Measuring Section

The measuring section in the present disclosure is a section configured to measure the fiber diameter of the sampled inorganic fiber.

The measuring section is not particularly limited as long as it is a section capable of measuring the fiber diameter of the inorganic fiber; and may be, for example, an automated fiber diameter measuring device, and may be a manual fiber diameter measuring device. The use of the automated fiber diameter measuring device as the measuring section is preferable in that it is easy to acquire the measured results continuously.

Also, common measures for measuring the fiber diameter of an inorganic fiber may be applied as the measuring section; and for example, a section measuring with an optical microscope or a scanning electron microscope, a section measuring by an image analysis, and a section measuring by a laser diffraction may be used. Incidentally, a section configured to treat the inorganic fiber to be subjected to measurement into an embodiment appropriate for the measurement according to the measuring section, may be provided; and examples of such a section may include a section configured to disperse the inorganic fiber into a solvent such as water, and a section configured to pulverize the inorganic fiber. Specifically, there is a treating process that complies with COMMISSION REGULATION (EC) No. 761/2009.

The measurement of the fiber diameter of the inorganic fiber may be carried out continuously or intermittently.

After measuring the fiber diameter of the inorganic fiber by the measuring section, whether the fiber diameter of the inorganic fiber is within a predetermined range set in advance, or not is confirmed.

4. Another Embodiment of Fiber Diameter Measuring Device

Another embodiment of the fiber diameter measuring device in the present disclosure is a fiber diameter measuring device configured to measure a fiber diameter of an inorganic fiber in an inorganic fiber sheet including the inorganic fiber and subjected to a needling treatment, the device comprising, a sampling section capable of sampling a predetermined amount of the inorganic fiber in an entire area of the inorganic fiber sheet; and a measuring section configured to measure a fiber diameter of the sampled inorganic fiber, and the sampling section includes at least a sample collecting section configured to collect the inorganic fiber.

B. Inorganic Fiber Sheet Producing Device

Next, the inorganic fiber sheet producing device in the present disclosure will be described. The inorganic fiber sheet producing device in the present disclosure is a device comprising the fiber diameter measuring device described above.

Figure 4:
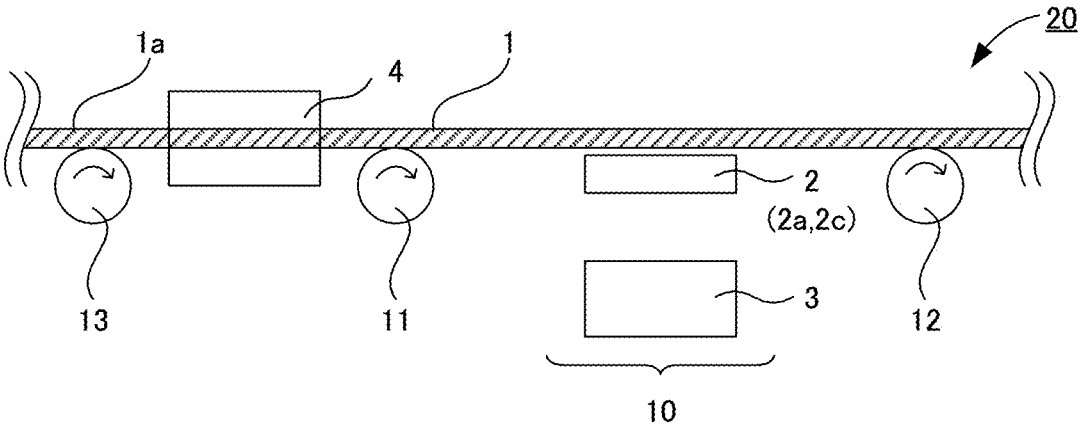
FIG. 4 is a schematic view illustrating an example of an inorganic fiber sheet producing device in the present disclosure.

FIG. 4 is a schematic view illustrating an example of an inorganic fiber sheet producing device in the present disclosure. Inorganic fiber sheet producing device 20 illustrated in FIG. 4 is an example of a producing device configured to produce a lengthy inorganic fiber sheet 1. As illustrated in FIG. 4, inorganic fiber sheet producing device 20 comprises fiber diameter measuring device 10 including sampling section 2 and measuring section 3. The fiber diameter measuring device 10 is similar to the fiber diameter measuring device 10 illustrated in FIG. 1 described above. Also, the inorganic fiber sheet producing device 20 further comprises burning section 4 configured to burn inorganic fiber precursor sheet 1*a* including an inorganic fiber precursor continuously, on the upstream side of the fiber diameter measuring device 10.

In the inorganic fiber sheet producing device 20 illustrated in FIG. 4, a lengthy inorganic fiber precursor sheet 1*a* and a lengthy inorganic fiber sheet 1 are conveyed by conveyance rolls 13, 11, and 12; and firstly, the inorganic fiber precursor sheet 1*a* is continuously burned by the burning section 4 to obtain the inorganic fiber sheet 1. Then, in the fiber diameter measuring device 10 including the sampling section 2 and the measuring section 3, a predetermined amount of the inorganic fiber is sampled in the entire area of the inorganic fiber sheet 1, and the fiber diameter of the sampled inorganic fiber is measured.

Incidentally, FIG. 4 is an example of a producing device configured to measure the fiber diameter of the inorganic fiber in a lengthy inorganic fiber sheet 1. However, although not illustrated in the figure, the inorganic fiber sheet producing device in the present disclosure may be, for example, a producing device including a cutting section configured to cut the inorganic fiber sheet, between the burning section and the fiber diameter measuring device, and may be a producing device configured to measure a fiber diameter of an inorganic fiber in a single sheet shaped inorganic fiber sheet.

According to the present disclosure, by comprising the fiber diameter measuring device described above, the continuous safeness of the fiber diameter of the inorganic fiber in the inorganic fiber sheet may be guaranteed, so that the reliability of the average fiber diameter and the fiber diameter distribution, for example, of the measured inorganic fiber may be improved. Specifically, the average fiber diameter and the fiber diameter distribution, for example, of the inorganic fiber in the entire area of the lengthy inorganic fiber sheet may be guaranteed. Therefore, an inorganic fiber sheet with further improved safeness may be provided.

Also, according to the present disclosure, by comprising the fiber diameter measuring device described above, it is possible to measure the fiber diameter of the inorganic fiber in the inorganic fiber sheet, not only after the production of the inorganic fiber sheet but also during the production of the inorganic fiber sheet. That is, the fiber diameter of the inorganic fiber in the inorganic fiber sheet may be measured on-line. Therefore, the average fiber diameter and the fiber diameter distribution of the inorganic fiber in the inorganic fiber sheet may be controlled on-line. Also, the variation of the average fiber diameter and the fiber diameter distribution, for example, of the inorganic fiber and deviation from acceptable range may be checked on-line. Therefore, by feeding the result back to the production process, for example, of the inorganic fiber sheet, and controlling the production conditions, for example, of the inorganic fiber sheet, the average fiber diameter, and the fiber diameter distribution, for example, of the inorganic fiber may be kept in an acceptable range.

Also, according to the present disclosure, by comprising the fiber diameter measuring device described above, an inorganic fiber sheet with good appearance even after the measurement of the fiber diameter may be obtained.

Hereinafter, each configuration of the inorganic fiber sheet producing device in the present disclosure is described.

1. Fiber Diameter Measuring Device

The fiber diameter measuring device in the present disclosure has been described in detail in "A. Fiber diameter measuring device" above; thus, the description herein is omitted.

2. Inorganic Fiber Sheet Producing Section

On the upstream side of the fiber diameter measuring device, the inorganic fiber sheet producing device in the present disclosure may be provided with an inorganic fiber sheet producing section configured to produce an inorganic fiber sheet.

The inorganic fiber sheet producing section is not particularly limited as long as it is a section capable of producing an inorganic fiber sheet.

The inorganic fiber sheet producing section may include, for example, a section configured to continuously produce a lengthy inorganic fiber sheet. Among them, the inorganic fiber sheet producing section preferably includes a burning section configured to continuously burn the inorganic fiber precursor sheet including an inorganic fiber precursor. This is because the fiber diameter distribution tends to vary when the inorganic fiber sheet is continuously produced, and it is particularly difficult to obtain a fiber diameter measuring sample representing the inorganic fiber sheet.

Examples of the inorganic fiber sheet producing section may include a first aspect including burning section configured to burn the inorganic fiber precursor sheet including an inorganic fiber precursor; and a second aspect including a papermaking sheet producing section configured to produce an inorganic fiber sheet which is a papermaking sheet. Hereinafter, each aspect will be described.

(1) First Aspect of Inorganic Fiber Sheet Producing Section

The first aspect of the inorganic fiber sheet producing section includes a burning section configured to burn the inorganic fiber precursor sheet including an inorganic fiber precursor.

(1-1) Burning Section

On the upstream side of the fiber diameter measuring device, the inorganic fiber sheet producing device in the present disclosure may be provided with a burning section configured to burn the inorganic fiber precursor sheet including the inorganic fiber precursor. Among them, the inorganic fiber sheet producing device in the present disclosure preferably comprises a burning section configured to continuously burn the inorganic fiber precursor sheet, including an inorganic fiber precursor, on the upstream side of the fiber diameter measuring device. This is because the present disclosure is useful for producing a lengthy inorganic fiber sheet.

Here, continuously burning the inorganic fiber precursor sheet means that the lengthy inorganic fiber precursor sheet is burned while conveyed.

The burning section is not particularly limited as long as it is a section capable of continuously burning the inorganic fiber precursor sheet; and a heating furnace, for example, may be used.

The burning temperature of the inorganic fiber precursor sheet may be, for example, 500° C. or more, preferably in a range of 1000° C. or more and 1300° C. or less.

(1-2) Other Section

The first aspect of the inorganic fiber sheet producing section may be provided with other section as needed, in addition to the burning section described above.

The inorganic fiber sheet producing device in the present disclosure may be provided with a needling section configured to carry out a needling treatment to the inorganic fiber precursor sheet, for example, on the upstream side or the downstream side of the burning section. In other words, the inorganic fiber precursor sheet may be one subjected to a needling treatment. Among them, when the inorganic fiber sheet producing section in the present aspect comprises a needling section, the needling section is preferably provided on the upstream side of the burning section. The present disclosure is useful for an inorganic fiber sheet obtained by burning an inorganic fiber precursor sheet subjected to a needling treatment.

Also, the inorganic fiber sheet producing device in the present disclosure may be provided with, for example, on the upstream side of the burning section and the needling section, a spinning section configured to spin a spinning solution to form an inorganic fiber precursor; and an inorganic fiber precursor sheet forming section configured to integrate the inorganic fiber precursor to form an inorganic fiber precursor sheet, in this order from the upstream side. In the spinning section, a short fibrous inorganic fiber precursor may be obtained.

Here, in the case of long fiber, it is easy to control the fiber diameter at the spinning stage, and it is easy to ensure safeness, since the control of the fiber length is easy at the cutting or the pulverizing stage, whereas in the case of short fiber, it is difficult to control the fiber diameter as compared with the long fiber.

In the first aspect of the inorganic fiber sheet producing section, in the spinning section, as described above, an inorganic fiber precursor in a short fibrous form is obtained. Therefore, it is difficult to guarantee the safeness of the inorganic fiber sheet obtained in the first aspect of the inorganic fiber sheet producing section unless examined, so that it is useful in the present disclosure.

(1-3) Inorganic Fiber Precursor Sheet

The inorganic fiber precursor sheet used in the present aspect is one including an inorganic fiber precursor. As described above, the inorganic fiber precursor is preferably spun as a short fiber.

The inorganic fiber precursor sheet may be lengthy or single sheet shape. Among them, the inorganic fiber precursor sheet is preferably lengthy. This is because the present disclosure is suitable for a lengthy inorganic fiber sheet.

When the inorganic fiber precursor sheet is one subjected to a needling treatment, it has a plurality of needle marks, that is, it has a plurality of recesses. The needle mark may be a through hole which penetrates through in the thickness direction of the inorganic fiber precursor sheet, and may be a non-through hole which does not penetrate through the sheet.

Incidentally the number of needle marks of the inorganic fiber precursor sheet may be the same as the number of needle marks of the inorganic fiber sheet described above.

The average thickness of the inorganic fiber precursor sheet is not particularly limited, and may be appropriately set depending on the application, for example.

Incidentally, the method for producing an inorganic fiber precursor sheet will be described in "C. Method for producing inorganic fiber sheet" later, and therefore, description thereof will be omitted here.

(2) Second Aspect of Inorganic Fiber Sheet Producing Section

On the upstream side of the fiber diameter measuring device, the inorganic fiber sheet producing device in the present disclosure may be provided with a papermaking sheet producing section configured to produce an inorganic fiber sheet which is a papermaking sheet.

The papermaking sheet producing section may include, for example, a papermaking section configured to make a slurry including an inorganic fiber, water, and a binder; and a drying section configured to dry the sheet obtained by the papermaking section.

Incidentally, the method for producing an inorganic fiber sheet which is a papermaking sheet will be described in "C. Method for producing inorganic fiber sheet" later, and therefore, description thereof will be omitted here.

The inorganic fiber sheet producing section in the present aspect may be provided with a needling section configured to subject a needling treatment to the inorganic fiber sheet, if necessary, on the upstream side of the papermaking sheet producing section.

(3) Other Aspects of Inorganic Fiber Sheet Producing Section

On the upstream side of the fiber diameter measuring device, the inorganic fiber sheet producing device in the present disclosure may be provided with a section configured to produce an inorganic fiber sheet, and a needling section configured to carry out a needling treatment to the inorganic fiber sheet. In other words, the inorganic fiber sheet producing section may be provided with a needling section regardless of which section produces the inorganic fiber sheet. The present disclosure is useful for an inorganic fiber sheet subjected to a needling treatment.

3. Other Section

The inorganic fiber sheet producing device in the present disclosure may be provided with other section as needed, in addition to the fiber diameter measuring device described above.

The inorganic fiber sheet producing device in the present disclosure may be provided with, for example, a winding section configured to wind the lengthy inorganic fiber sheet into a roll-shaped manner, on the downstream side of the fiber diameter measuring device. Alternatively, the inorganic fiber sheet producing device in the present disclosure may include a cutting section configured to cut an inorganic fiber sheet, for example, between the burning section and the fiber diameter measuring device.

The inorganic fiber sheet producing device in the present disclosure may be provided with an impregnation section configured to impregnate a binder liquid into the inorganic fiber sheet; and a drying section configured to dry the binder liquid impregnated inorganic fiber sheet formed by impregnating inorganic fiber sheet with a binder liquid, for example, on the downstream side of the fiber diameter measuring device.

C. Method for Measuring a Fiber Diameter

Next, a method for measuring a fiber diameter in the present disclosure will be described. The method for measuring a fiber diameter in the present disclosure is a method for measuring a fiber diameter measuring a fiber diameter of an inorganic fiber in an inorganic fiber sheet including the inorganic fiber, the method comprising, a sampling step of sampling the inorganic fiber from the inorganic fiber sheet by a sampling method capable of sampling a predetermined amount of the inorganic fiber in an entire area of the inorganic fiber sheet; and a measuring step of measuring the fiber diameter of the sampled inorganic fiber.

According to the present disclosure, since a predetermined amount of the inorganic fiber may be sampled in the entire area of the inorganic fiber sheet in the sampling step, it is possible to improve the reliability of the fiber diameter of the measured inorganic fiber. Also, since the inorganic fiber sheet is not punched out or cut out for sampling, the fiber diameter of the inorganic fiber in the inorganic fiber sheet may be measured on-line. Still more, since the appearance of the inorganic fiber sheet may be suppressed from being impaired by measurement of the fiber diameter, the inorganic fiber sheet may be used as a product even after measurement of the fiber diameter.

Hereinafter, each step in the method for measuring a fiber diameter in the present disclosure will be described.

1. Sampling Step

The sampling step in the present disclosure is a step of sampling the inorganic fiber from the inorganic fiber sheet by a sampling method capable of sampling a predetermined amount of the inorganic fiber in an entire area of the inorganic fiber sheet.

A method of sampling the inorganic fiber is not particularly limited as long as it is a method capable of sampling a predetermined amount of the inorganic fiber in the entire area of the inorganic fiber sheet, and examples thereof may include a sampling method with the sampling section described in the section "A. Fiber diameter measuring device, 2. Sampling section" above.

The inorganic fiber sheet subjected to the sampling step is one including the inorganic fiber. Also, the inorganic fiber sheet subjected to the sampling step is preferably subjected to a needling treatment. The inorganic fiber sheet may be the same as those described in the section "A. Fiber diameter measuring device, 1. Inorganic fiber sheet" above.

2. Measuring Step

The measuring step in the present disclosure is a step of measuring the fiber diameter of the sampled inorganic fiber.

As a method for measuring the fiber diameter of the inorganic fiber, a known method may be applied, and examples thereof may include the measurement method according to measuring section described in the section "A. Fiber diameter measuring device, 3. Measuring section" above.

The rest of the measuring step may be the same as those described in "A. Fiber diameter measuring device, 3. Measuring section" above.

3. Other Steps

In the method for measuring a fiber diameter in the present disclosure, it is preferable to carry out a step of removing dust, fiber, for example, generated in the producing process of an inorganic fiber sheet and dust and fiber floating in the atmosphere, immediately before the sampling step.

D. Method for Producing Inorganic Fiber Sheet

Next, the method for producing an inorganic fiber sheet in the present disclosure will be described. The method for producing an inorganic fiber sheet in the present disclosure is a method for producing comprising a sampling step of sampling an inorganic fiber from an inorganic fiber sheet by a sampling method capable of sampling a predetermined amount of the inorganic fiber in an entire area of the inorganic fiber sheet including the inorganic fiber; and a measuring step of measuring the fiber diameter of the sampled inorganic fiber.

FIG. 4 is a schematic view illustrating an example of the method for producing an inorganic fiber sheet in the present disclosure. FIG. 4 is an example of a method for producing wherein a fiber diameter of an inorganic fiber in a lengthy inorganic fiber sheet 1 is measured. As illustrated in FIG. 4, firstly, the lengthy inorganic fiber precursor sheet 1*a* is conveyed with conveyance roll 13 to burning section 4; and at burning section 4, continuously conveyed inorganic fiber precursor sheet 1*a* is burned to be inorganic fiber sheet 1. Then, while continuously conveying the lengthy inorganic fiber sheet 1 with conveyance rolls 11 and 12, the inorganic fiber is suctioned from the lower side of the inorganic fiber sheet 1 being conveyed, by sample transferring section 2*a* (suctioning section) to collect the inorganic fiber. Then, the fiber diameter of the sampled inorganic fiber is measured by measuring section 3.

According to the present disclosure, since a predetermined amount of the inorganic fiber may be sampled in the entire area of the inorganic fiber sheet in sampling step, the sampled inorganic fiber may be regarded as representing the inorganic fiber in the inorganic fiber sheet. Therefore, the continuous safeness of the fiber diameter of the inorganic fiber in the inorganic fiber sheet may be guaranteed, so that the reliability of the average fiber diameter and the fiber diameter distribution, for example, of the measured inorganic fiber may be improved. Specifically, for a lengthy inorganic fiber sheet, the average fiber diameter and the fiber diameter distribution, for example, of the inorganic fiber in the entire area of the lengthy inorganic fiber sheet may be guaranteed. Therefore, an inorganic fiber sheet with further improved safeness may be provided.

Also, according to the present disclosure, since the inorganic fiber is sampled by a method capable of sampling a predetermined amount of the inorganic fiber in the entire area of the inorganic fiber sheet in the sampling step, the inorganic fiber sheet is not punched out or cut out for sampling. Therefore, the fiber diameter of the inorganic fiber in the inorganic fiber sheet may be measured, not only after the production of the inorganic fiber sheet but also during the production of the inorganic fiber sheet. That is, the fiber diameter of the inorganic fiber in the inorganic fiber sheet may be measured on-line. Therefore, the average fiber diameter and the fiber diameter distribution, for example, of the inorganic fiber in the inorganic fiber sheet may be controlled on-line.

Also, according to the present disclosure, since the inorganic fiber is sampled by a method capable of sampling a predetermined amount of the inorganic fiber in the entire area of the inorganic fiber sheet in sampling step, the inorganic fiber sheet is not punched out or cut out for sampling. Therefore, the appearance of the inorganic fiber sheet may be suppressed from being impaired. Therefore, an inorganic fiber sheet having good appearance even after the measurement of the fiber diameter may be obtained.

Hereinafter, each step in the method for producing an inorganic fiber sheet in the present disclosure will be described. Incidentally, each step in the method for producing an inorganic fiber sheet in the present disclosure may be described by citing each step in a method for producing an alumina fiber sheet which is an aspect of the inorganic fiber sheet in the present disclosure, as an example in some cases.

1. Inorganic Fiber Sheet Producing Step

The method for producing an inorganic fiber sheet in the present disclosure includes an inorganic fiber sheet producing step of producing an inorganic fiber sheet, prior to the sampling step. In the inorganic fiber sheet producing step, a method for producing an inorganic fiber sheet is not particularly limited.

In the inorganic fiber sheet producing step, for example, a lengthy inorganic fiber sheet may be produced continuously. Among them, the inorganic fiber sheet producing step preferably includes a preparing step of preparing an inorganic fiber precursor sheet including an inorganic fiber precursor; and a burning step of burning the inorganic fiber precursor sheet continuously to obtain the inorganic fiber sheet. This is because the fiber diameter distribution tends to vary when inorganic fiber sheet is continuously produced, and it is particularly difficult to obtain a fiber diameter measuring sample representing the inorganic fiber sheet.

Examples of the inorganic fiber sheet producing step may include a first aspect including a preparing step of preparing an inorganic fiber precursor sheet including an inorganic fiber precursor, and a burning step of burning the inorganic fiber precursor sheet to obtain the inorganic fiber sheet; and a second aspect including a papermaking sheet producing step of producing an inorganic fiber sheet which is a papermaking sheet. Hereinafter, each aspect will be described.

(1) First Aspect of Inorganic Fiber Sheet Producing Step

Prior to the sampling step, the method for producing an inorganic fiber sheet in the present disclosure may include a preparing step of preparing an inorganic fiber precursor sheet including an inorganic fiber precursor; and a burning step of burning the inorganic fiber precursor sheet to obtain the inorganic fiber sheet.

(1-1) Preparing Step

The preparing step in the present aspect is a step of preparing an inorganic fiber precursor sheet including an inorganic fiber precursor. In a method for producing an alumina fiber sheet which is an aspect of the inorganic fiber sheet in the present disclosure, the preparing step is a step of preparing an alumina fiber precursor sheet including an alumina fiber precursor.

As the method for producing an inorganic fiber precursor sheet, a known method may be applied, and is not particularly limited. For example, the preparing step may include a preparing step of preparing a spinning solution; a spinning step of forming an inorganic fiber precursor by spinning the spinning solution; and an inorganic fiber precursor sheet forming step of forming an inorganic fiber precursor sheet by integrating the inorganic fiber precursor. In the spinning step, for example, a blowing method, and a spinning method, for example, may be used. Also, in the spinning step, a short fibrous inorganic fiber precursor may be obtained.

Here, as described above, in the case of short fiber, it is difficult to control the fiber diameter as compared with a long fiber. In the first aspect of the inorganic fiber sheet producing step, in the spinning step, as described above, an inorganic fiber precursor in a short fibrous form is obtained. Therefore, it is difficult to guarantee the safeness of the inorganic fiber sheet obtained in the first aspect of the inorganic fiber sheet producing step unless examined, so that it is useful in the present disclosure.

As the method for producing an alumina fiber precursor sheet, a known method may be applied, and is not particularly limited. Examples thereof may include a method wherein a spinning solution including an aluminum compound is prepared, the spinning solution is spun to form an alumina fiber precursor, the alumina fiber precursor is integrated to form an alumina fiber precursor sheet, and a needling treatment is carried out to the alumina fiber precursor sheet.

The preparation of the spinning solution may be carried out according to a conventional method. The spinning solution, for example, may be prepared by adding a silicon compound to an aqueous basic aluminum chloride solution prepared by dissolving aluminum in hydrochloric acid. As the silicon compound, a silica sol is suitably used, and a water-soluble silicon compound such as tetraethylsilicate and a water-soluble siloxane derivative may be used.

In the spinning solution, the ratio of aluminum and silicon is preferably in a range of 60:40 to 98:2 in terms of $Al_2O_3/SiO_2$ mass ratio, more preferably in a range of 65:35 to 95:5, and particularly preferably in a range of 70:30 to 80:20. When the silicon component is too much, fiberization is easy, but heat resistance may be remarkably lowered. Meanwhile, when the silicon component is too low, the fiber may be easily embrittled.

Also, in order to improve spinnability, the spinning solution preferably includes a spinning auxiliary agent. Examples of the spinning auxiliary agent may include water-soluble organic polymers such as polyvinyl alcohol, polyethylene glycol, polyacrylamide, starch, and cellulose derivatives.

The spinning solution may be prepared, for example, by adding a silicon compound and an organic polymer to an aqueous basic aluminum chloride solution, and concentrating thereof as appropriate. The viscosity of the spinning solution at ordinary temperature may be, for example, approximately 10 poise or more and 100 poise or less.

The formation of the alumina fiber precursor from the spinning solution may be carried out according to a conventional method. Examples of the formation of an alumina fiber precursor from a spinning solution may include a blowing method wherein a spinning solution is supplied into a high speed spinning air stream. As the nozzle for the blowing method, either one of the following two types may be used: a type wherein a spinning solution nozzle is installed in an air flow nozzle configured to generate a spinning air stream; and a type wherein a spinning solution nozzle is installed so as to supply the spinning solution from the outside of the spinning air stream. When spinning by the blowing method, for example, it is possible to use a method wherein an endless belt made of a wire mesh is installed so as to be substantially perpendicular to the spinning air stream, and while rotating the endless belt, a formed spinning air stream including an alumina fiber precursor is bombarded thereto. The alumina fiber precursor formed by this spinning has a diameter of usually several μm, and a length of several tens of mm to several hundreds of mm.

By integrating the alumina fiber precursor, an alumina fiber precursor sheet may be obtained. In producing an alumina fiber precursor sheet, an alumina fiber precursor may be integrated to form a single layer sheet, and a thin layer sheet obtained by integrating an alumina fiber precursor may be stacked.

The method for stacking the thin-layer sheet is not particularly limited. For example, a method for producing a stacked sheet including alumina fiber precursors, disclosed in JP-A No. 2000-80547 may be applied. Specifically, a method for producing a stacked sheet including alumina fiber precursor may be applied, wherein an alumina fiber precursor is deposited on an integrating device to form a thin sheet of alumina fiber precursor; the thin sheet is continuously taken out from the integrating device and forwarded to a folding device; folded to a predetermined width and stacked while continuously transferring in a direction perpendicular to the folding direction. In this method for producing a stacked sheet including alumina fiber precursor, the thin sheet is continuously taken out from the integrating device, and is continuously transferred transversely to the folding direction while being folded and stacked in the transferring direction of the thin sheet. Therefore, the width to be folded is equal to the width of the stacked sheet to be formed. Thus, both end portions in the width direction of the thin sheet is dispersed in the stacked sheet to be formed, so that the weight of the stacked sheet per unit area becomes even over the entire stacked sheet. Such a method for producing a stacked sheet including an alumina fiber precursor is one of a producing method wherein a sheet shape is formed after going through a stack by zigzag foldings.

Incidentally, the needling treatment will be described later.

(1-2) Burning Step

The burning step in the present aspect is a step of burning an inorganic fiber precursor sheet. The burning step is preferably a step of continuously burning the inorganic fiber precursor sheet to obtain an inorganic fiber sheet.

The burning of the inorganic fiber precursor sheet may be carried out according to a conventional method. Incidentally, the burning temperature is the same as that described in the section of "B. Inorganic fiber sheet producing device" above.

(1-3) Needling Step

In the present aspect, the method for producing an inorganic fiber sheet may include a needling step of subjecting a needling treatment to the inorganic fiber precursor sheet, before or after the burning step. This is because the present disclosure is suitable for an inorganic fiber sheet subjected to a needling treatment. Among them, when the inorganic fiber sheet producing step in the present aspect includes a needling step, the needling step is preferably included prior to the burning step. The present disclosure is useful for an inorganic fiber sheet obtained by burning an inorganic fiber precursor sheet subjected to a needling treatment.

By subjecting a needling treatment to the inorganic fiber precursor sheet, an inorganic fiber precursor sheet having high mechanical strength wherein the inorganic fiber precursor is also oriented in the thickness direction of the inorganic fiber precursor sheet, may be obtained.

For the needling treatment, a known method may be applied, and is not particularly limited. For example, it may be similar to the needling treatment disclosed in WO 2016/152795.

The needling hole density may be, for example, 1 hole/$cm^2$ or more and 50 holes/$cm^2$ or less. Generally, the greater the number of needling holes, the greater the bulk density and peeling strength of the resulting inorganic fiber precursor sheet.

(2) Second Aspect of Inorganic Fiber Sheet Producing Step

The method for producing an inorganic fiber sheet in the present disclosure may include a papermaking sheet producing step of producing an inorganic fiber sheet which is a papermaking sheet, prior to the sampling step.

The inorganic fiber sheet which is a papermaking sheeting may be produced by a known method. The papermaking sheet producing step may include, for example, a papermaking step of making a slurry including an inorganic fiber, water, and a binder; and a drying step of drying the sheet obtained in the papermaking step. Also, prior to the papermaking step, the papermaking sheet producing step may include a defibrating step of defibrating an inorganic fiber; and a slurry preparing step of preparing a slurry including the defibrated inorganic fiber as the inorganic fiber. For each step, a known method may be applied.

The inorganic fiber included in the slurry may be, for example, that obtained by spinning long fiber and cutting or pulverizing thereof into short fiber; and may be that spun as short fiber. Among them, the inorganic fiber is preferably that was spun as short fiber. Here, as described above, in the case of short fiber, it is difficult to control the fiber diameter as compared with the long fiber. Therefore, the present disclosure is suitable for an inorganic fiber spun as a short fiber, which is difficult to guarantee the safeness unless examined.

The inorganic fiber sheet producing step in the present aspect may include, as necessary, after the papermaking sheet producing step, a needling step of subjecting a needling treatment to the inorganic fiber sheet.

(3) Other Aspects of Inorganic Fiber Sheet Producing Step

Prior to the sampling step, the method for producing an inorganic fiber sheet in the present disclosure may include a needling step of subjecting a needling treatment to the inorganic fiber sheet. In other words, the inorganic fiber sheet producing step may include the needling step regardless how an inorganic fiber sheet is produced. The present disclosure is useful for an inorganic fiber sheet subjected to a needling treatment.

2. Sampling Step

The sampling step in the present disclosure is an inorganic step of sampling the inorganic fiber from the inorganic fiber sheet by a sampling method capable of sampling a predetermined amount of the inorganic fiber in an entire area of the inorganic fiber sheet.

A method for sampling the inorganic fiber is not particularly limited as long as it is a method capable of sampling a predetermined amount of the inorganic fiber in the entire area of the inorganic fiber sheet, and examples thereof may include a sampling method according to the sampling section described in the section "A. Fiber diameter measuring device, 2. Sampling section" above.

In the present disclosure, the burning step and the sampling step are preferably carried out continuously. The reason therefor is to sample the inorganic fiber to be subjected to the measurement of the fiber diameter, from the inorganic fiber sheet, on-line.

The inorganic fiber sheet to be subjected to the sampling step is preferably one subjected to a needling treatment. By carrying out the needling step, an inorganic fiber sheet subjected to a needling treatment may be obtained.

3. Measuring Step

The measuring step in the present disclosure is a step of measuring the fiber diameter of the sampled inorganic fiber.

As a method for measuring the fiber diameter of an inorganic fiber, a known method may be applied, and examples thereof may include a measurement method according to the measuring section described in the section "A. Fiber diameter measuring device, 3. Measuring section" above.

Incidentally, the rest of the measuring step may be the same as those described in "A. Fiber diameter measuring device, 3. Measuring section" above.

In the present disclosure, the burning step, the sampling step, and the measuring step are preferably carried out continuously. The reason therefor is to measure the fiber diameter of the inorganic fiber in the inorganic fiber sheet on-line.

4. Feedback and Control

In the present disclosure, when the fiber diameter measured in the measuring step is out of a previously set predetermined range, a result thereof may be fed back, and producing conditions of the inorganic fiber precursor sheet and/or burning conditions in the burning step may be controlled so that the fiber diameter is in the predetermined range. Variation of the average fiber diameter and the fiber diameter distribution of the inorganic fiber and deviation from acceptable range may be checked on-line. Therefore, by feeding the result back, and controlling the producing conditions of the inorganic fiber precursor sheet, and/or the burning conditions in the burning step, the average fiber diameter and the fiber diameter distribution of the inorganic fiber may be kept in a predetermined range.

When the measured fiber diameter is out of a previously set predetermined range, the result is fed back to control the producing conditions of the inorganic fiber precursor sheet and/or the burning conditions in the burning step so that the fiber diameter is in the predetermined range. Meanwhile, when the measured fiber diameter is in the predetermined range, the current producing conditions of the inorganic fiber precursor sheet and the burning conditions in the burning step are maintained.

The previously set predetermined range of the fiber diameter is, for example, a range of value appropriately set according to the specifications, for example, of the inorganic fiber sheet.

Specifically, whether the average fiber diameter, the standard deviation of the fiber diameter distribution, the minimum fiber diameter, and the maximum fiber diameter, for example, satisfy the specifications or not; and whether a target range is met or not, are confirmed. Alternatively, whether there is a singular point in the fiber diameter (such as presence or absence of the fiber having a fiber diameter of 3 μm or less) or not, is confirmed.

A method for controlling the producing conditions of the inorganic fiber precursor sheet and/or the burning conditions in the burning step in order to adjust the fiber diameter may be appropriately set depending on whether the fiber diameter satisfies the predetermined range or not.

Examples of the method for controlling the producing conditions of the inorganic fiber precursor sheet in order to adjust the fiber diameter may include a control of the preparing conditions of a spinning solution, and a control of the spinning conditions. Examples of the method for controlling the preparing conditions of the spinning solution in order to adjust the fiber diameter may include a control of the viscosity of the spinning solution.

Also, examples of the method for controlling the burning conditions in the burning step in order to adjust the fiber diameter may include a control of the burning temperature.

The feedback and the control may be carried out automatically or manually.

5. Other Steps

In addition to the steps described above, the method for producing an inorganic fiber sheet in the present disclosure may include other steps, as necessary.

In the method for producing an inorganic fiber sheet in the present disclosure, prior to the sampling step, it is preferable to carry out a step of removing floating fiber and dust, for example, deposited and/or adhered to the inorganic fiber sheet during each of the steps described above and from the atmosphere, so that floating fiber and dust, for example, deposited and/or adhered to the inorganic fiber sheet during each of the steps described above and from the atmosphere does not affect the result of the fiber diameter measurement.

After the measuring step, the method for producing an inorganic fiber sheet in the present disclosure may include, for example, a winding step of winding the lengthy inorganic fiber sheet into a roll-shaped manner. Alternatively, between the burning step and the measuring step, the method for producing an inorganic fiber sheet in the present disclosure may include, for example, a cutting step of cutting the inorganic fiber sheet.

After the measuring step, for example, the method for producing an alumina fiber sheet which is an aspect of the inorganic fiber sheet in the present disclosure may include an impregnation step of impregnating a binder liquid into the alumina fiber sheet; and a drying step of drying the binder liquid impregnated alumina fiber sheet formed by impregnating the alumina fiber sheet with the binder liquid.

6. Another Embodiment of Method for Producing Inorganic Fiber Sheet

Another embodiment of the method for producing an inorganic fiber sheet in the present disclosure comprises a preparing step of preparing an inorganic fiber precursor sheet including an inorganic fiber precursor and subjected to a needling treatment; a burning step of burning the inorganic fiber precursor sheet continuously to obtain an inorganic fiber sheet including an inorganic fiber and subjected to a needling treatment; sampling step of sampling an inorganic fiber from an inorganic fiber sheet by a sampling method capable of sampling a predetermined amount of the inorganic fiber in an entire area of the inorganic fiber sheet; and a measuring step of measuring the fiber diameter of the sampled inorganic fiber.

Incidentally, the present disclosure is not limited to the embodiments. The embodiments are exemplification, and any other variations are intended to be included in the technical scope of the present disclosure if they have substantially the same constitution as the technical idea described in the claim of the present disclosure and offer similar operation and effect thereto.

EXAMPLES

The present disclosure is hereinafter explained in further details with reference to Example and Reference Examples.

Example 1

The raw fabric of a lengthy crystalline alumina/silica fiber sheet (Maftec (registered trade mark) from Mitsubishi Chemical Corporation) with 2400 gsm, a width of 150 mm and a length of 500 mm was prepared, and an ultrasonic dry cleaner for web (HG Cleaner VUV-HGv-130 from Shinko Co., Ltd.) was used as a nozzle head, and the inorganic fiber was collected at a suction quantity of 500 L/min while discharging the compressed air of 0.3 MPa. Incidentally, a nozzle head was placed on the upper side of the crystalline alumina/silica fiber sheet, and a feed rate of the crystalline alumina/silica fiber sheet in this case was set to 500 mm/min, and a PTFE membrane filter (Omnipore from Merck KGaA) with a pore diameter of 1 μm was used as a filter for collecting an inorganic fiber. The amount of the collected inorganic fiber was 0.05 g.

Next, with respect to the collected inorganic fiber, the collected inorganic fiber was treated in a manner complying with the COMMISSION REGULATION (EC) No 761/2009, and the diameter of approximately 300 inorganic fibers was measured using an optical microscope.

Reference Example 1

The crystalline alumina/silica fiber sheet after collecting the inorganic fiber in Example 1 was punched out at six places with a cork borer of 25 mm φ uniformly in the width direction of the alumina/silica fiber sheet complying with COMMISSION REGULATION (EC) No 761/2009, and the six test pieces were dispersed into 300 mL of water to obtain a stock solution of a representative sample in the width direction (widthwise representative sample). Then, in the same manner as in the preparing procedure of the stock solution of the widthwise representative sample described above, a stock solution of a widthwise representative sample was prepared in every 100 mm in the longitudinal direction, and the stock solution of a widthwise representative sample at 5 locations was obtained on the alumina/silica fiber sheet, by summing up with the stock solution of the widthwise representative sample described above.

Then, after sufficiently stirring the stock solution of the obtained widthwise representative sample, 50 mL of the sample was taken out into an empty container, 250 mL of water was added, and sufficiently stirred to obtain a dilution solution of the widthwise representative sample. The obtaining procedure of the dilution solution was carried out for all of the stock solutions of the 5 widthwise representative samples described above to prepare respective dilution solutions.

Then, by measuring the dilution solution of each widthwise representative sample using an optical microscope, the diameter of approximately 300 inorganic fibers of the widthwise representative samples was measured. Each widthwise representative sample was numbered from 1 to 5 in order from one side in the arbitrary longitudinal direction, and the measured values were distinguished from each other.

Reference Example 2

From each dilution solution of each widthwise representative sample prepared in Reference Example 1, 60 mL each was taken out, mixed in an empty container, and sufficiently stirred, thereby obtaining a 300 mL alumina/silica fiber dispersion. Since the alumina/silica fiber dispersion is a mixed liquid of each widthwise representative sample, it may be regarded as one of the representative samples of alumina/silica fiber sheet. With respect to the alumina/silica fiber dispersion, the diameter of approximately 300 inorganic fibers representing the alumina/silica fiber sheet was measured using an optical microscope.

Reference Example 3

From each of the widthwise representative sample stock solutions prepared in Reference Example 1, 10 mL each was taken out, mixed with 250 mL of water in an empty container, and sufficiently stirred. Thereby obtaining a 300 mL alumina/silica fiber dispersion solution. Since the alumina/silica fiber dispersion solution was a mixed liquid of each widthwise representative sample, it may be regarded as one of the representative samples of the alumina/silica fiber sheet. With respect to the alumina/silica fiber dispersion solution, the diameter of approximately 300 inorganic fibers representing the alumina/silica fiber sheet was measured using an optical microscope.

TABLE 1

| | | Number of measured fibers | Average fiber diameter (μm) | Detected number of fibers with diameter of less than 3.0 μm |
|---|---|---|---|---|
| Example 1 | | 339 | 6.48 | 0 |
| Reference Ex. 1 | Widthwise representative 1 | 332 | 6.13 | 0 |
| | Widthwise representative 2 | 329 | 6.29 | 0 |
| | Widthwise representative 3 | 341 | 6.54 | 0 |
| | Widthwise representative 4 | 334 | 6.32 | 0 |
| | Widthwise representative 5 | 332 | 6.27 | 0 |
| | Widthwise representative average | — | 6.34 | 0 |
| Reference Ex. 2 | | 330 | 6.43 | 0 |
| Reference Ex. 3 | | 338 | 6.24 | 0 |

[Evaluation]

Figure 5:
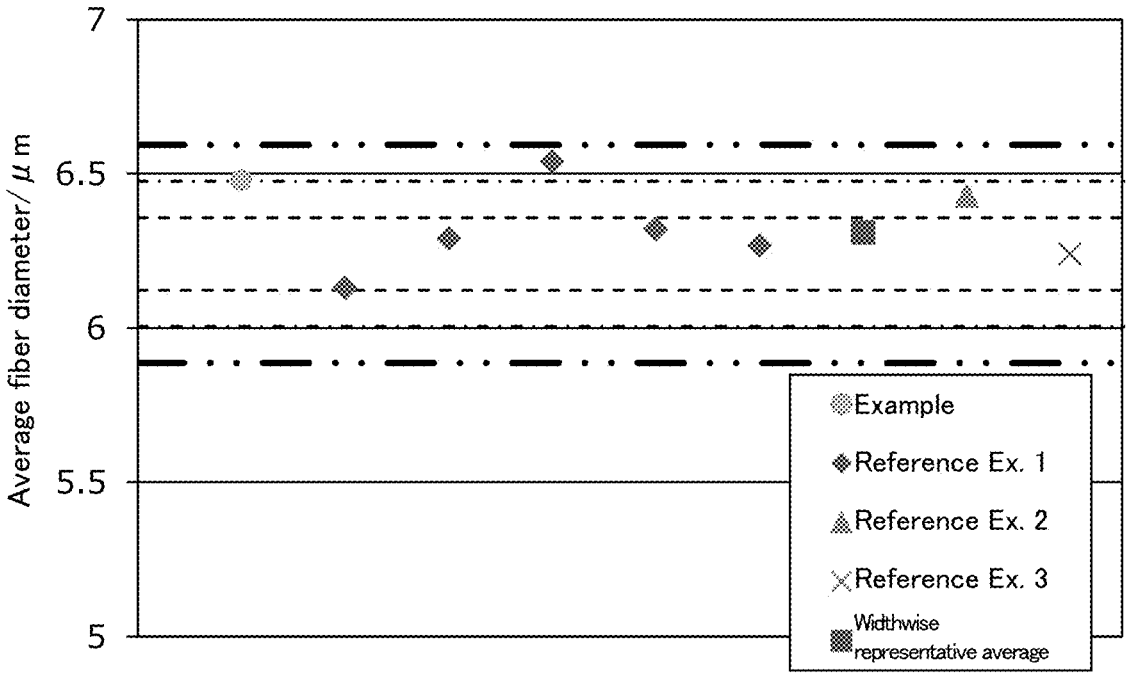
FIG. 5 is an average fiber diameter distribution diagram in Example and Reference Examples.

Table 1 and FIG. 5 show the measurement results of the number average fiber diameter and the detected number of fibers with diameter of less than 3.0 μm in Example 1 and Reference Examples 1 to 3. The plots of reference example 1 shown in FIG. 5 are: widthwise representative 1, widthwise representative 2, widthwise representative 3, widthwise representative 4, and widthwise representative 5 shown in Table 1, respectively, in order from the left. Also, when the standard deviation calculated from the five points in Reference Example 1 is regarded as σ (sigma), the dashed line indicates the average value ±σ, the one-dot chain indicates the average value ±2σ, long two-dot chain indicates the average value ±3σ. The average fiber diameter in Example 1 was present in the variation of the average fiber diameter of the five samples in Reference Example 1, which are widthwise representative samples (since Reference Example 1 was representative in the widthwise direction in samples respectively prepared from the same crystalline alumina/silica fiber sheet, the probability density of each value is considered to follow a normal distribution, and the variation is within the average value ±3σ), which indicates a value close to the average fiber diameters in Reference Examples 2 and 3, which are representative samples of the alumina/silica fiber sheets. From these results, it is found that the method for measuring a fiber diameter disclosed in the present disclosure was capable of obtaining the same results as a conventional method for measuring a fiber diameter offline complying with COMMISSION REGULATION (EC) No 761/2009.

REFERENCE SIGNS LIST

1: inorganic fiber sheet
1*a*: inorganic fiber precursor sheet
2: sampling section
2*a*: sample transferring section
2*b*: feeding section
2*c*: sample collecting section
2*d*: vibration section
3: measuring section
4: burning section
10: fiber diameter measuring device
11, 12, 13: conveyance roll
20: inorganic fiber sheet producing device

The invention claimed is:

1. A fiber diameter measuring device configured to measure a fiber diameter of an inorganic fiber in an inorganic fiber sheet including the inorganic fiber, the device comprising, a sampling section capable of on-line sampling a predetermined amount of the inorganic fiber in an entire area of the inorganic fiber sheet; and a measuring section configured to measure a fiber diameter of the sampled inorganic fiber, wherein the sampling section is further capable of the on-line sampling the predetermined amount of the inorganic fiber in the entire area of the inorganic fiber sheet as the inorganic fiber remains in conveyance, the predetermined amount of the inorganic fiber in the entire area of the inorganic fiber sheet consisting of an area of the inorganic fiber sheet that is less than the entire area of the inorganic fiber sheet.

2. The fiber diameter measuring device according to claim 1, wherein the sampling section includes a sample transferring section placed on one side or both sides of the inorganic fiber sheet, and configured to transfer the inorganic fiber.

3. The fiber diameter measuring device according to claim 2, wherein the sample transferring section is a suctioning section configured to suction the inorganic fiber.

4. The fiber diameter measuring device according to claim 1, wherein the sampling section includes a pretreating section configured to assist the sampling of the inorganic fiber.

5. The fiber diameter measuring device according to claim 4, wherein the pretreating section is a physically contactless section configured to be physically contactless with the inorganic fiber sheet.

6. The fiber diameter measuring device according to claim 5, wherein the physically contactless section is a feeding section configured to feed a gas or a liquid to the inorganic fiber sheet, from one side or both sides of the inorganic fiber sheet.

7. The fiber diameter measuring device according to claim 4, wherein the pretreating section is a physically contacting section configured to be in physically contact with the inorganic fiber sheet.

8. The fiber diameter measuring device according to claim 4, wherein, as the pretreating section, the sampling section includes a vibration section configured to impart a vibration to the inorganic fiber sheet.

9. The fiber diameter measuring device according to claim 1, wherein the sampling section includes a sample collecting section configured to collect the inorganic fiber.

10. An inorganic fiber sheet producing device comprising the fiber diameter measuring device according to claim 1.

11. The inorganic fiber sheet producing device according to claim 10, wherein a burning section configured to burn an inorganic fiber precursor sheet including an inorganic fiber precursor continuously, is provided on an upstream side of the fiber diameter measuring device.

12. A method for measuring a fiber diameter measuring a fiber diameter of an inorganic fiber in an inorganic fiber sheet including the inorganic fiber, the method comprising, a sampling step of on-line sampling the inorganic fiber from the inorganic fiber sheet by a sampling method capable of sampling a predetermined amount of the inorganic fiber in an entire area of the inorganic fiber sheet; and a measuring step of measuring the fiber diameter of the sampled inorganic fiber, wherein the sampling method comprises on-line sampling the predetermined amount of the inorganic fiber in the entire area of the inorganic fiber sheet as the inorganic fiber remains in conveyance, the predetermined amount of the inorganic fiber in the entire area of the inorganic fiber sheet consisting of an area of the inorganic fiber sheet that is less than the entire area of the inorganic fiber sheet.

13. The method for measuring a fiber diameter according to claim 12, wherein, in the sampling step, the inorganic fiber is transferred by a sample transferring section placed on one side or both sides of the inorganic fiber sheet, and configured to transfer the inorganic fiber.

14. The method for measuring a fiber diameter according to claim 12, wherein, in the sampling step, the sampling of the inorganic fiber is assisted by a pretreating section configured to assist the sampling of the inorganic fiber.

15. A method for producing an inorganic fiber sheet, the method comprising, a sampling step of sampling an inorganic fiber from an inorganic fiber sheet by a sampling method capable of on-line sampling a predetermined amount of the inorganic fiber in an entire area of the inorganic fiber sheet including the inorganic fiber; and a measuring step of measuring the fiber diameter of the sampled inorganic fiber, wherein the sampling method comprises on-line sampling the predetermined amount of the inorganic fiber in the entire area of the inorganic fiber sheet as the inorganic fiber remains in conveyance, the predetermined amount of the inorganic fiber in the entire area of the inorganic fiber sheet consisting of an area of the inorganic fiber sheet that is less than the entire area of the inorganic fiber sheet.

16. The method for producing an inorganic fiber sheet according to claim 15, wherein, in the sampling step, the inorganic fiber is transferred by a sample transferring section placed on one side or both sides of the inorganic fiber sheet, and configured to transfer the inorganic fiber.

17. The method for producing an inorganic fiber sheet according to claim 15, wherein, in the sampling step, the sampling of the inorganic fiber is assisted by a pretreating section configured to assist the sampling of the inorganic fiber.

18. The method for producing an inorganic fiber sheet according to claim 15, wherein, prior to the sampling step, the method comprises a preparing step of preparing an inorganic fiber precursor sheet including an inorganic fiber precursor; and a burning step of burning the inorganic fiber precursor sheet continuously to obtain the inorganic fiber sheet.

19. The method for producing an inorganic fiber sheet according to claim 18, wherein, when the fiber diameter measured in the measuring step is out of a previously set predetermined range, a result thereof is fed back, and a producing condition of the inorganic fiber precursor sheet and/or a burning condition in the burning step is controlled so that the fiber diameter is in the predetermined range.

20. The method for producing an inorganic fiber sheet according to claim 15, wherein the inorganic fiber sheet subjected to the sampling step is an inorganic fiber sheet subjected to a needling treatment.

* * * * *